US012152793B2

(12) United States Patent
Chen et al.

(10) Patent No.: US 12,152,793 B2
(45) Date of Patent: Nov. 26, 2024

(54) AIR CONDITIONER

(71) Applicant: Hisense (Guangdong) Air Conditioning Co., Ltd., Guangdong (CN)

(72) Inventors: Hongjie Chen, Jiangmen (CN); Wei Tang, Jiangmen (CN); Zhiwen Liang, Jiangmen (CN)

(73) Assignee: HISENSE (GUANGDONG) AIR CONDITIONING CO., LTD., Jiangmen (CN)

( * ) Notice: Subject to any disclaimer, the term of this patent is extended or adjusted under 35 U.S.C. 154(b) by 172 days.

(21) Appl. No.: 17/897,592

(22) Filed: Aug. 29, 2022

(65) Prior Publication Data

US 2023/0167984 A1 Jun. 1, 2023

(30) Foreign Application Priority Data

Nov. 26, 2021 (CN) ..... 202122945573.X
Nov. 29, 2021 (CN) ..... 202122963576.6
(Continued)

(51) Int. Cl.
*F24F 1/02* (2019.01)
*F24F 13/20* (2006.01)
*F24F 13/22* (2006.01)

(52) U.S. Cl.
CPC ..... *F24F 1/02* (2013.01); *F24F 13/20* (2013.01); *F24F 13/224* (2013.01); *F24F 2221/20* (2013.01)

(58) Field of Classification Search
CPC .. F24F 1/02; F24F 1/029; F24F 1/0323; F24F 1/027; F24F 12/20; F24F 12/224; F24F 2221/20
See application file for complete search history.

(56) References Cited

U.S. PATENT DOCUMENTS 10,527,311 B2 1/2020 Seo et al.
10,935,257 B2 3/2021 Jung et al.
(Continued)

FOREIGN PATENT DOCUMENTS

CN 202902497 U * 4/2013
CN 113280408 A 8/2021

OTHER PUBLICATIONS

Non-Final Office Action issued in corresponding U.S. Appl. No. 17/897,601 dated Aug. 26, 2024.

*Primary Examiner* — Emmanuel E Duke
(74) *Attorney, Agent, or Firm* — Morgan, Lewis & Bockius LLP

(57) ABSTRACT

An air conditioner includes an indoor unit, an outdoor unit, and an inductor assembly. The indoor unit includes an indoor air duct component. The outdoor unit includes an outdoor air duct component. The indoor air duct component and the outdoor air duct component are spaced apart. The inductor assembly is located between the indoor air duct component and the outdoor air duct component, and includes an inductor box shell, an inductor and an inductor box cover. The inductor box shell has an accommodating space and includes a shell side plate, a first heat dissipation opening, a first water blocking portion, a shell top plate and a second heat dissipation opening. The inductor is disposed in the accommodating space. The inductor box cover is disposed on top of the inductor box shell, and includes a cover top plate, a third heat dissipation opening and a second water blocking portion.

20 Claims, 19 Drawing Sheets

(30) Foreign Application Priority Data

| | | |
|---|---|---|
| Nov. 29, 2021 | (CN) | 202122963727.8 |
| Nov. 29, 2021 | (CN) | 202122963796.9 |
| Nov. 29, 2021 | (CN) | 202122964872.8 |

(56) References Cited

U.S. PATENT DOCUMENTS

| | | | | |
|---|---|---|---|---|
| 2006/0021370 | A1 | 2/2006 | Cho et al. | |
| 2023/0044599 | A1* | 2/2023 | Liu | F24F 1/24 |

* cited by examiner

AIR CONDITIONER

CROSS-REFERENCE TO RELATED APPLICATIONS

The present disclosure claims priorities to Chinese Patent application No. 202122945573.X, filed on Nov. 26, 2021, Chinese Patent application No. 202122964872.8, filed on Nov. 29, 2021, Chinese Patent application No. 202122963796.9, filed on Nov. 29, 2021, Chinese Patent application No. 202122963576.6, filed on Nov. 29, 2021, and Chinese Patent application No. 202122963727.8, filed on Nov. 29, 2021, which are incorporated herein by reference in their entireties.

TECHNICAL FIELD

The present disclosure relates to the field of household appliance technologies, and in particular, to an air conditioner.

BACKGROUND

The window air conditioner is a small air conditioner that may be installed in the window, and has the advantages of less manufacturing materials and low cost. In addition, as an all-in-one machine, the window air conditioner has lower installation requirements and technical requirements, and is often used in bedrooms, offices or other places.

SUMMARY

Some embodiments of the present disclosure provide an air conditioner, and the air conditioner includes an indoor unit, an outdoor unit, and an inductor assembly. The indoor unit includes an indoor air duct component. The outdoor unit includes an outdoor air duct component. The indoor air duct component and the outdoor air duct component are spaced apart. The inductor assembly is located between the indoor air duct component and the outdoor air duct component, and includes an inductor box shell, an inductor and an inductor box cover. The inductor box shell has an accommodating space and includes a shell side plate, a first heat dissipation opening, a first water blocking portion, a shell top plate and a second heat dissipation opening. The first heat dissipation opening penetrates through the shell side plate along a thickness direction thereof. The first water blocking portion corresponds to the first heat dissipation opening, and extends from an upper edge of the first heat dissipation opening to an outer side of the inductor box shell and downward, so as to block the first heat dissipation opening. The shell top plate is disposed on top of the shell side plate. The second heat dissipation opening penetrates through the shell top plate along a thickness direction thereof. The inductor is disposed in the accommodating space. The inductor box cover is disposed on top of the inductor box shell, and includes a cover top plate, a third heat dissipation opening and a second water blocking portion. The third heat dissipation opening is disposed on the cover top plate and communicates with the second heat dissipation opening. The second water blocking portion is disposed at the third heat dissipation opening.

DETAILED DESCRIPTION

Figure 1A:
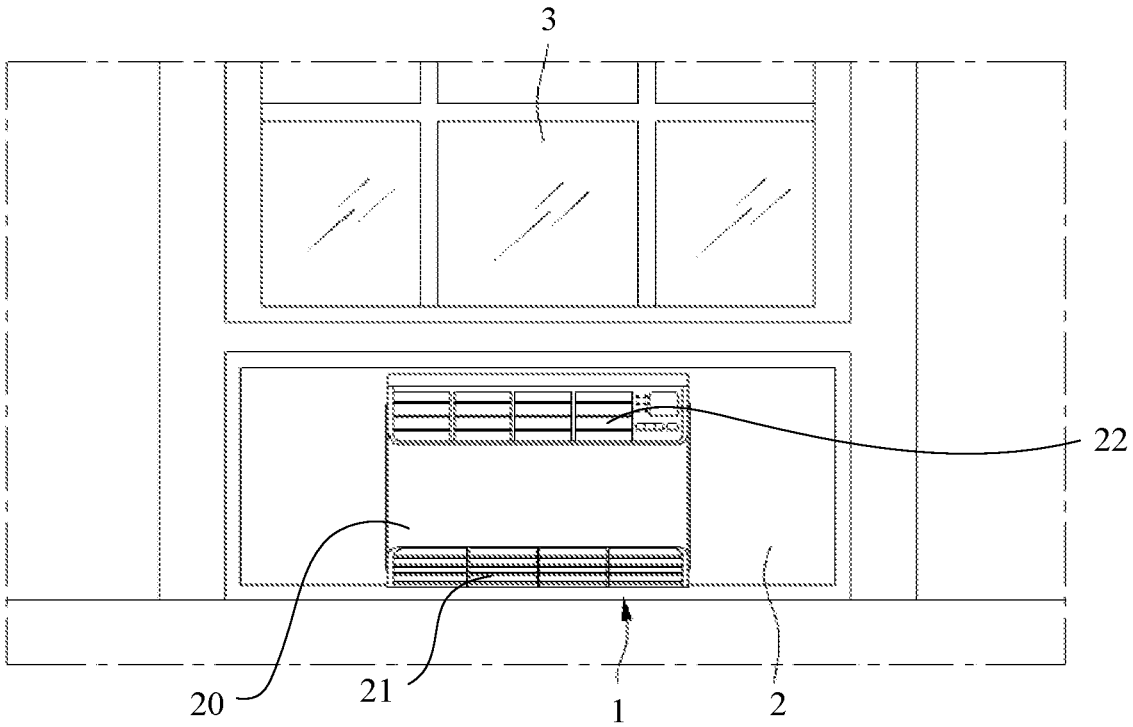
FIG. 1A is a structural diagram of an air conditioner installed in a wall, in accordance with some embodiments.

In some embodiments of the present disclosure will be described clearly and completely with reference to the accompanying drawings below. However, the described embodiments are merely some but not all embodiments of the present disclosure. All other embodiments obtained by a person of ordinary skill in the art on a basis of the embodiments of the present disclosure shall be included in the protection scope of the present disclosure.

Unless indicated otherwise, throughout the description and the claims, the term "comprise" and other forms thereof such as the third-person singular form "comprises" and the present participle form "comprising" are construed as an open and inclusive meaning, i.e., "including, but not limited to". In the description, the term such as "one embodiment", "some embodiments", "exemplary embodiments", "example", "specific example" or "some examples" is intended to indicate that specific features, structures, materials, or characteristics related to the embodiment(s) or example(s) are included in at least one embodiment or example of the present disclosure. Schematic representations of the above terms do not necessarily refer to the same embodiment(s) or example(s). In addition, specific features, structures, materials, or characteristics described herein may be included in any one or more embodiments or examples in any suitable manner.

Hereinafter, the terms such as "first" and "second" are used for descriptive purposes only, and are not to be construed as indicating or implying the relative importance or implicitly indicating the number of indicated technical features. Thus, features defined by "first" and "second" may explicitly or implicitly include one or more of the features. In the description of the embodiments of the present disclosure, the term "a/the plurality of" means two or more unless otherwise specified.

The use of "applicable to" or "configured to" herein means an open and inclusive expression, which does not exclude devices that are applicable to or configured to perform additional tasks or steps.

The term "about", "substantially" and "approximately" as used herein includes a stated value and an average value within an acceptable range of deviation of a particular value determined by a person of ordinary skill in the art, considering measurement in question and errors associated with measurement of a particular quantity (i.e., limitations of a measurement system).

As used herein, "parallel", "perpendicular" and "equal" include the stated conditions and the conditions similar to the stated conditions, and the range of the similar conditions is within the acceptable deviation range, where the acceptable deviation range is determined by a person of ordinary skill in the art in consideration of the measurement in question and the error associated with the measurement of a specific quantity (i.e., the limitation of the measurement system).

For ease of description, unless otherwise specified, the orientation expressions of up, down, left, right, front and rear in the present disclosure are all referred to a state of an air conditioner when it is in use. A side of the air conditioner facing the user when the air conditioner is in use (i.e., the side of the air conditioner facing the indoor) is the front side, and an opposite side is the rear side. A height direction of the air conditioner is an up-down direction. A left-right direction of the air conditioner is opposite to a left-right direction of the user, for example, a left side of the air conditioner is a right side of the user, and a right side of the air conditioner is a left side of the user.

<Air Conditioner>

Some embodiments of the present disclosure provide an air conditioner 1. The air conditioner 1 may be installed in a wall 2 or a window 3 of a building. FIG. 1A is a structural diagram of an air conditioner installed in a wall, in accordance with some embodiments. Referring to FIG. 1A, an installation space for installing the air conditioner 1 is provided in the wall 2 of the building. The air conditioner 1 may be embedded and installed in the installation space, and a first part of the air conditioner 1 is located indoors, and a second part of the air conditioner 1 is located outdoors.

<Housing>

Figure 1B:
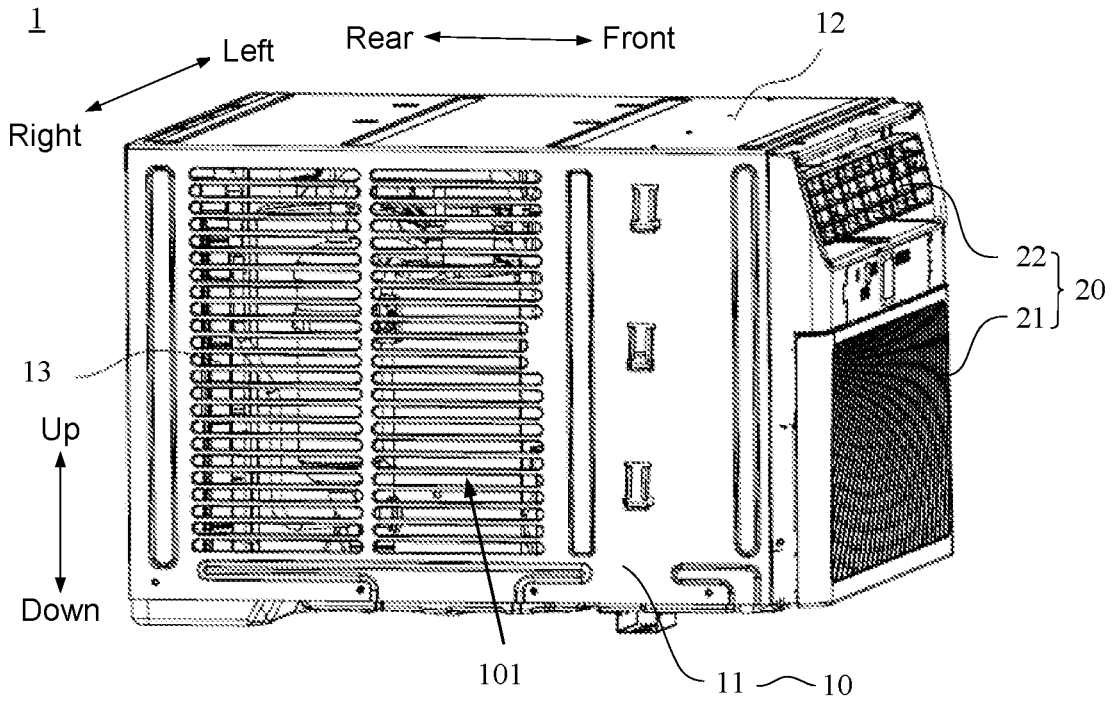
FIG. 1B is a perspective view of an air conditioner, in accordance with some embodiments.

FIG. 1B is a perspective view of an air conditioner, in accordance with some embodiments. Referring to FIG. 1B, in some embodiments, the air conditioner 1 includes a housing 10 whose front side is open (i.e., the housing 10 has an opening at its front side). The housing 10 defines a mounting chamber. The housing 10 includes a housing side plate 11 and a housing top plate 12 connected on top of the housing side plate 11.

In some embodiments, the housing 10 includes two housing side plates 11, the two housing side plates 11 are disposed opposite to each other in a width direction (e.g., the left-right direction) of the air conditioner 1, and are connected to the housing top plate 12.

In some embodiments, as shown in FIG. 1B, the housing side plate 11 includes a plurality of ventilation holes 13, and outdoor fresh air may enter the housing 10 through the plurality of ventilation holes 13.

For example, the ventilation holes 13 are elongated through holes, and extend along a longitudinal direction (i.e., a front-rear direction of the air conditioner 1) of the housing 10. The plurality of ventilation holes 13 are arranged at intervals along the height direction of the housing 10.

It can be understood that, when the air conditioner 1 is installed in the installation space, the housing 10 is divided in the front-rear direction into a front part of the housing (i.e., a part of the housing 10 corresponding to the first part of the air conditioner 1) located indoors, a middle part of the housing located in the installation space, and a rear part of the housing (i.e., a part of the housing corresponding to the second part of the air conditioner 1) located outdoors, the plurality of ventilation holes 13 are located on the rear part of the housing.

<Front Cover Plate>

In some embodiments, referring to FIG. 1B, the air conditioner 1 further includes a front cover plate 20. The front cover plate 20 is connected to a front end of the housing 10 and configured to block the opening of the housing 10. For example, the front cover plate 20 may be connected to the housing 10 in a clamping manner or a threading manner, the present disclosure is not limited thereto.

The front cover plate 20 includes an air suction portion 21 and an air exhaust portion 22. Indoor return air may enter the air conditioner 1 through the air suction portion 21, and fresh air in the air conditioner 1 may enter the indoor through the air exhaust portion 22. For example, the suction portion 21 is configured as a suction grill, and the exhaust portion 22 is configured as an exhaust grill.

<Main Body>

In some embodiments, as shown in FIG. 1B, the air conditioner 1 further includes a main body 101. The main body 101 is disposed in the installation chamber of the housing 10, and the main body 101 is detachably connected to the housing 10, so as to facilitate the assembly and disassembly of the air conditioner 1. In addition, in a case where the main body 101 malfunctions, the main body 101 may be disassembled from the housing 10, so as to facilitate maintenance of the main body 101.

Figure 2A:
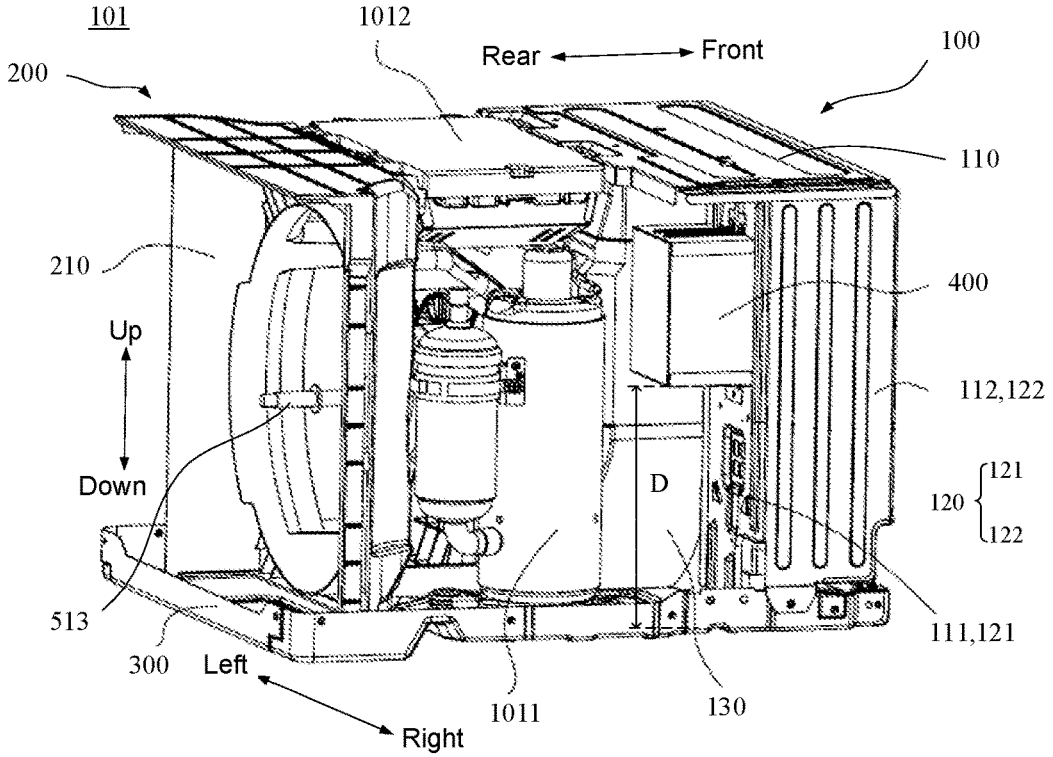
FIG. 2A is a perspective view of a main body, in accordance with some embodiments.
Figure 2B:
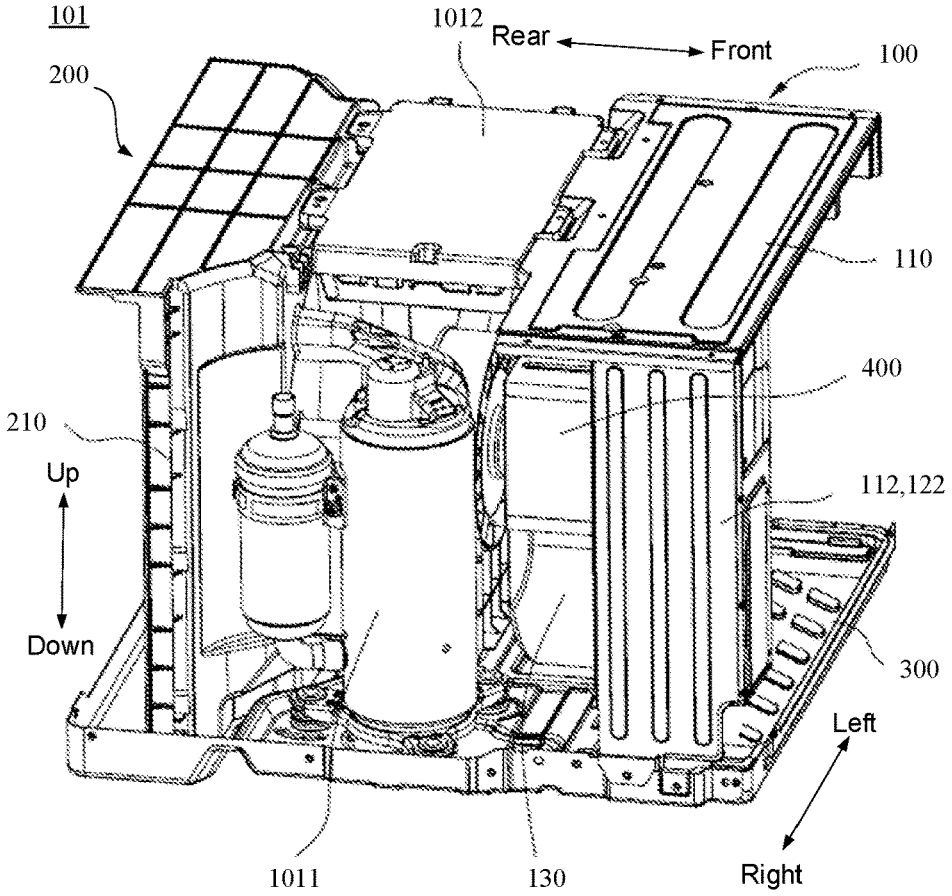
FIG. 2B is another perspective view of a main body, in accordance with some embodiments.
Figure 3:
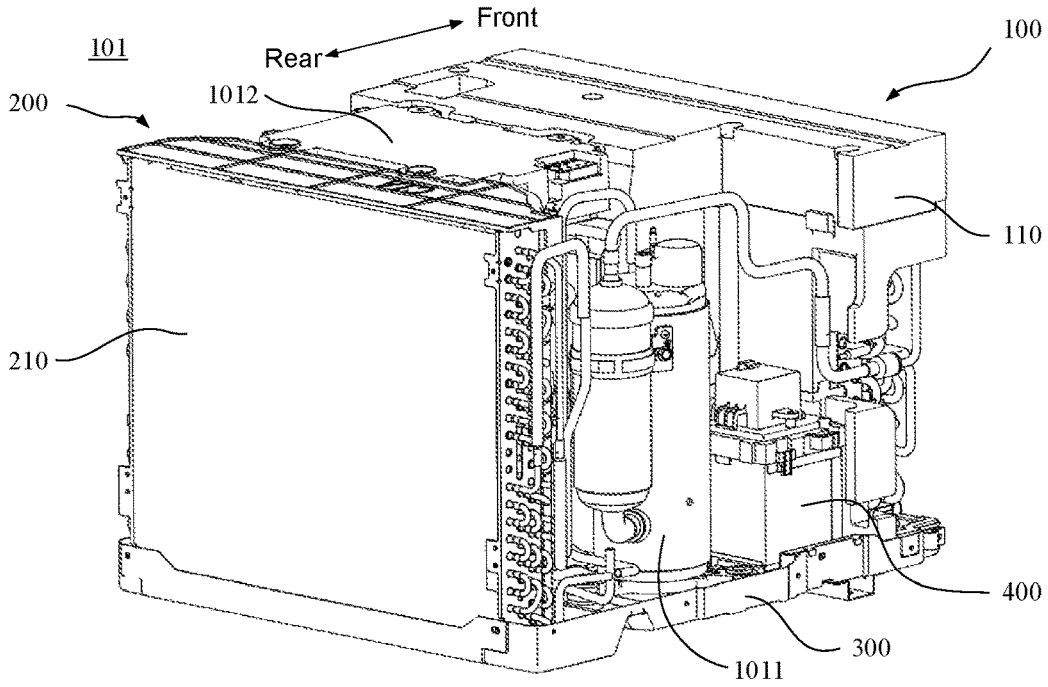
FIG. 3 is a perspective view of another main body, in accordance with some embodiments.
Figure 4:
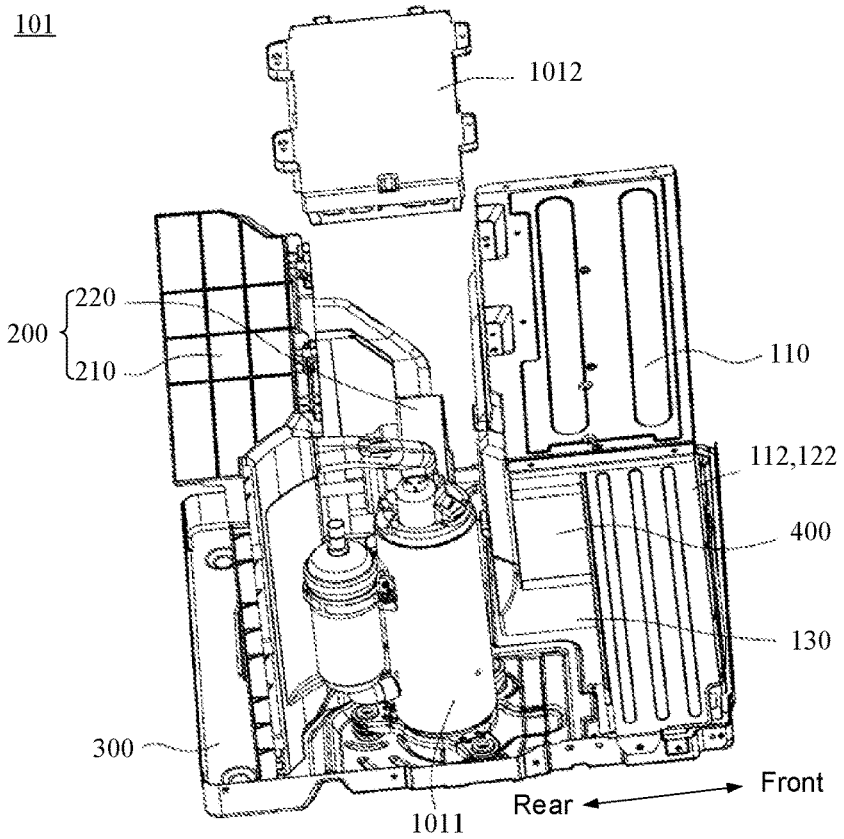
FIG. 4 is an exploded view of a main body, in accordance with some embodiments.

FIG. 2A is a perspective view of a main body, in accordance with some embodiments. FIG. 2B is another perspective view of a main body, in accordance with some embodiments. FIG. 3 is a perspective view of another main body, in accordance with some embodiments. FIG. 4 is an exploded view of a main body, in accordance with some embodiments.

As shown in FIGS. 2A to 4, the main body 101 includes an indoor unit 100, an outdoor unit 200, and a base 300. For example, the indoor unit 100 and the outdoor unit 200 may be disposed on the base 300, and the indoor unit 100 is closer to the front cover plate 20 than the outdoor unit 200. The indoor unit 100 includes an indoor air duct component 110, and the outdoor unit 200 includes an outdoor air duct component 210.

<Compressor>

In some embodiments, as shown in FIGS. 2A and 2B, the main body 101 further includes a compressor 1011. For example, the compressor 1011 may be disposed on the base 300 and located between the indoor air duct component 110 and the outdoor air duct component 210. The compressor 1011 is configured to compress refrigerant in the air conditioner 1, so that the refrigerant with low pressure is compressed to be refrigerant with high pressure.

<Inductor Assembly>

In some embodiments, referring to FIGS. 2A and 2B, the main body 101 further includes an inductor assembly 400. The inductor assembly 400 is located on a side (e.g., the rear side) of the indoor air duct component 110 proximate to the outdoor air duct component 210.

In some embodiments, as shown in FIG. 3, a lower end of the inductor assembly 400 is fixedly connected to the base 300. In some other embodiments, as shown in FIGS. 2A and 2B, the inductor assembly 400 is spaced apart from the base 300 by a preset distance D. In this case, the inductor assembly 400 is not in contact with the base 300. In this way, a heat exchange area between the inductor assembly 400 and the air may be increased, which is conducive to improving a heat dissipation efficiency of the inductor assembly 400.

Figure 5:
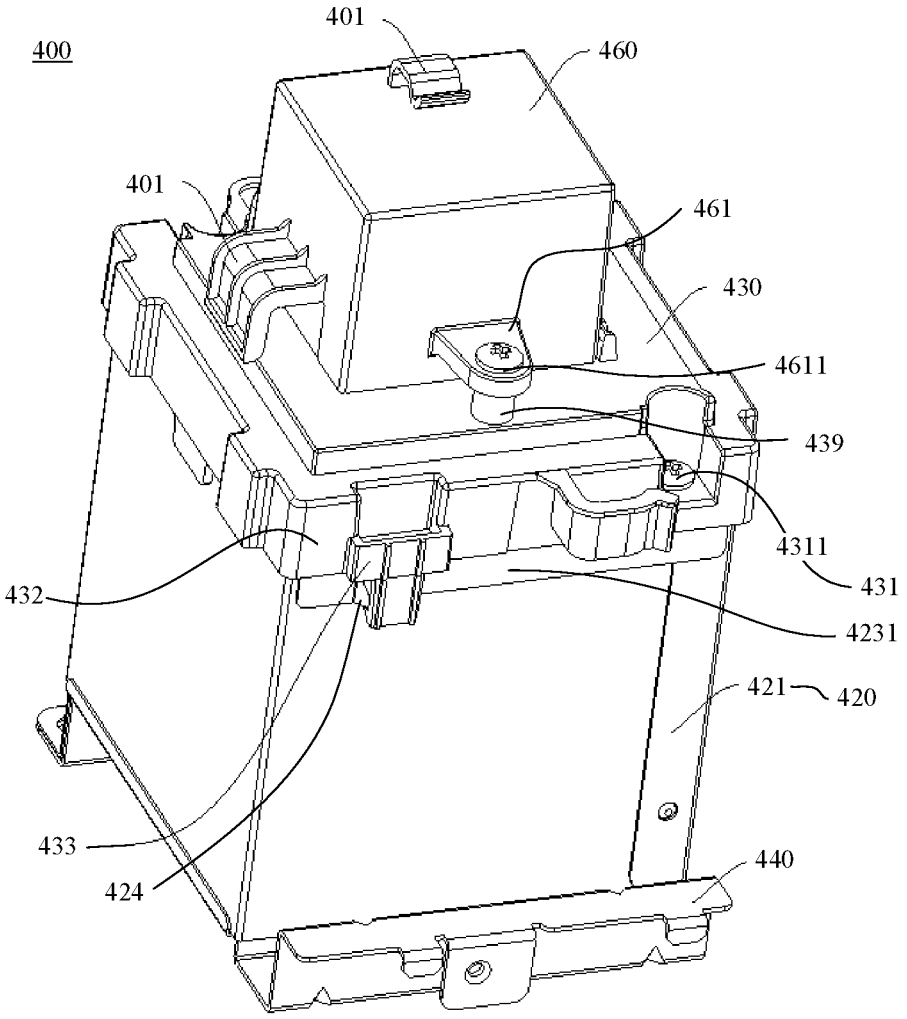
FIG. 5 is a perspective view of an inductor assembly, in accordance with some embodiments.
Figure 6:
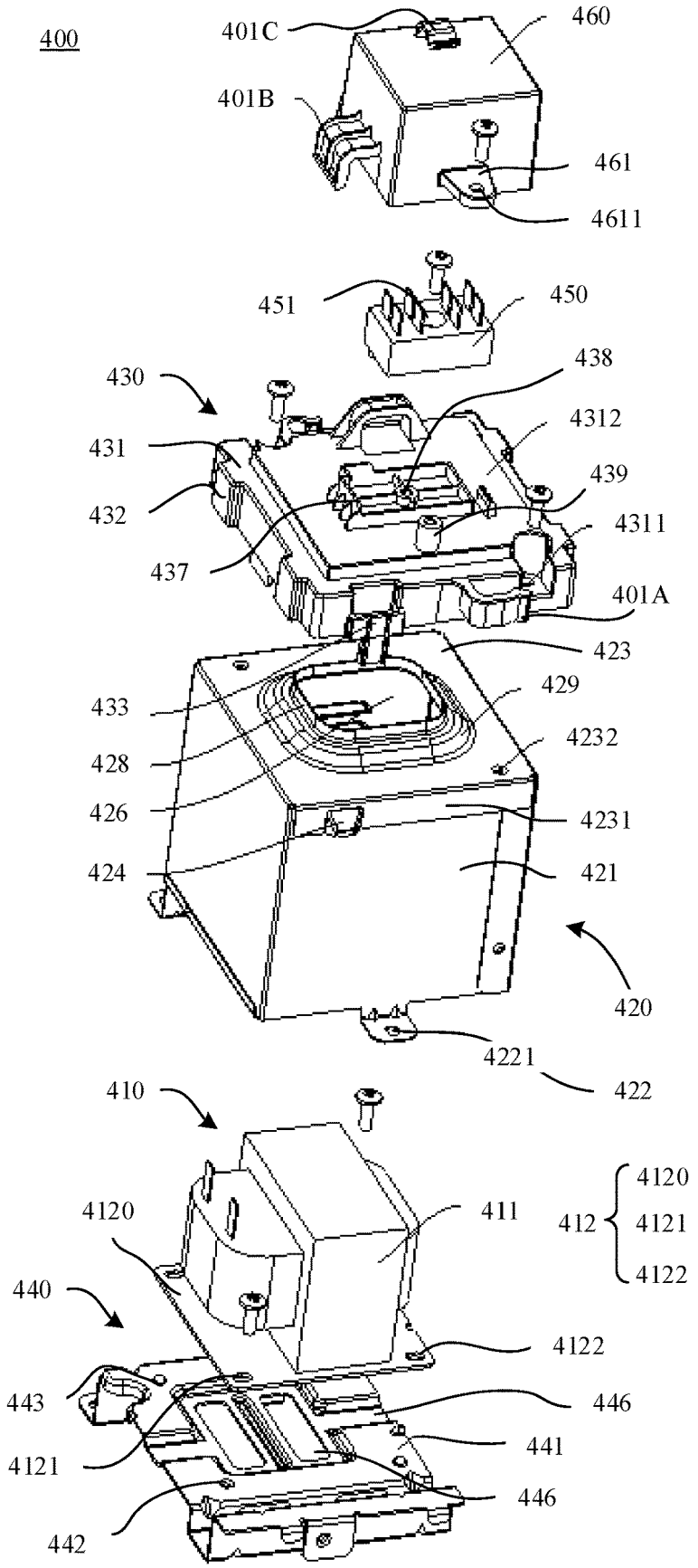
FIG. 6 is an exploded view of an inductor assembly, in accordance with some embodiments.

FIG. 5 is a perspective view of an inductor assembly, in accordance with some embodiments. FIG. 6 is an exploded view of an inductor assembly, in accordance with some embodiments.

In some embodiments, as shown in FIGS. 5 and 6, the inductor assembly 400 includes an inductor 410 and an inductor box. The inductor box includes a shell 420 (which is called an inductor box shell 420), a cover 430 (which is called an inductor box cover 430), and a base 440 (which is called an inductor box base 440). An upper end of the inductor box shell 420 is connected to the inductor box cover 430, and a lower end of the inductor box shell 420 is connected to the inductor box base 440.

It will be noted that, both the inductor 410 and the inductor box shell 420 are fixedly connected to the inductor box base 440. Alternatively, the inductor 410 is fixedly connected to the inductor box shell 420, and the inductor box shell 420 is fixedly connected to the inductor box base 440. The present disclosure is not limited thereto.

For example, referring to FIG. 6, the inductor 410 includes an inductor body 411 and a connecting plate 412. A lower end of the inductor body 411 is fixedly connected to the connecting plate 412. The connecting plate 412 includes a connecting plate body 4120, a first connecting hole 4121 and a first protruding portion 4122. The first connecting hole 4121 penetrates through the connecting plate body 4120 along a thickness direction thereof. The first protruding portion 4122 extends from an upper surface of the connecting plate body 4120 toward a direction proximate to the inductor body 411, so as to provide a receiving groove with an opening downward.

Figure 11:
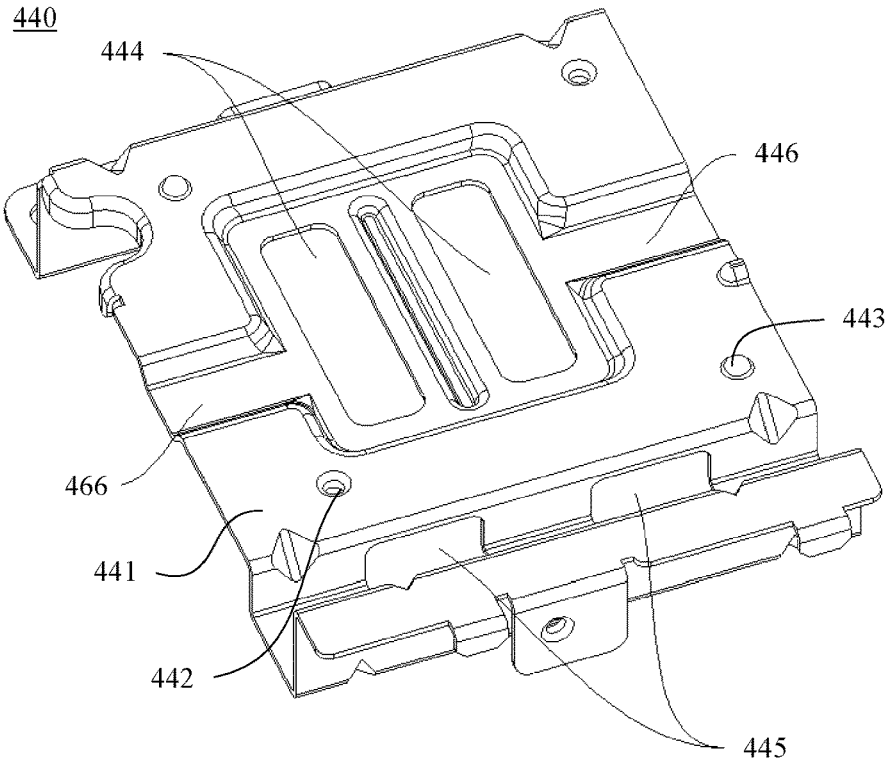
FIG. 11 is a perspective view of an inductor box base, in accordance with some embodiments.

FIG. 11 is a perspective view of an inductor box base, in accordance with some embodiments. Referring to FIGS. 6 and 11, the inductor box base 440 includes a base body 441, a second connecting hole 442 and a second protruding portion 443. The second protruding portion 443 protrudes toward the connecting plate 412 from the base body 441 and corresponds to a position of the receiving groove. In this way, by providing the second protruding portion 443 in the receiving groove, the inductor 410 may be positioned on the inductor box base 440. A position of the second connecting hole 442 corresponds to a position of the first connecting hole 4121. A fastener (e.g., a screw or bolt) is inserted through the second connecting hole 442 and the first connecting hole 4121, so that a fixedly connection between the inductor 410 and the inductor box base 440 may be achieved.

In some embodiments, the connecting plate 412 includes a plurality of first connecting holes 4121 and a plurality of first protruding portions 4122, and the plurality of first protruding portions 4122 define a plurality of the receiving grooves that open their mouths downward. In some embodiments, the inductor box base 440 includes a plurality of second connecting holes 442 and a plurality of second protruding portions 443. The plurality of second connecting holes 442 correspond to the plurality of first connecting holes 4121, and the plurality of second protruding portions 443 correspond to the plurality of the receiving grooves. In this way, it is conducive to improving a connection reliability between the inductor 410 and the inductor box base 440.

Figure 7:
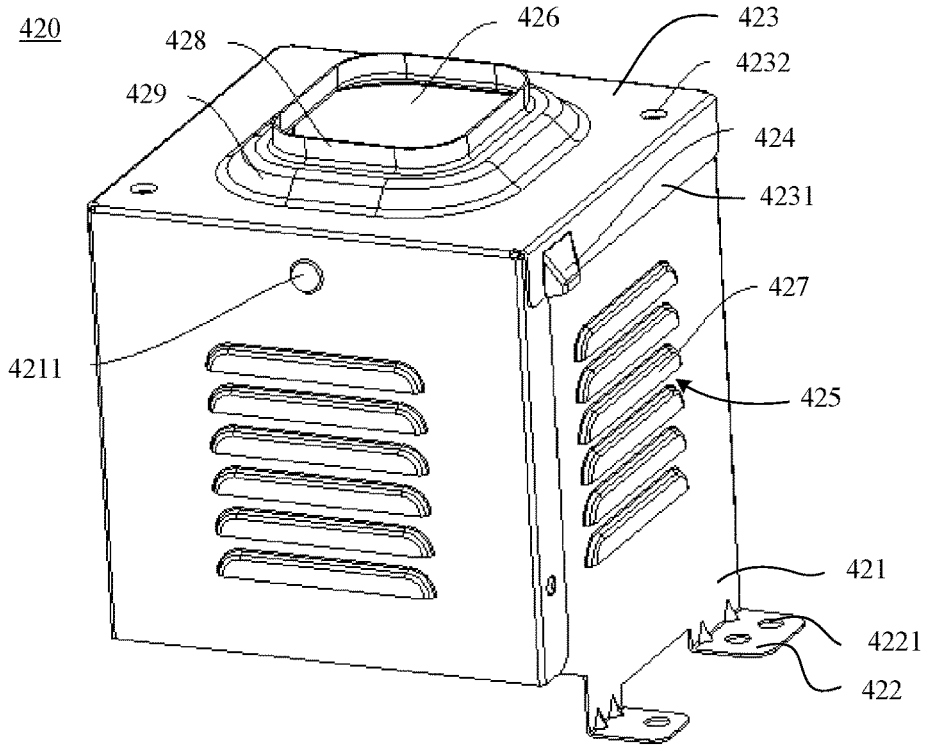
FIG. 7 is a perspective view of an inductor box shell, in accordance with some embodiments.

FIG. 7 is a perspective view of an inductor box shell, in accordance with some embodiments. Referring to FIGS. 6 and 7, the inductor box shell 420 includes a side plate 421 (which is called a shell side plate 421) and a first connecting portion 422. The first connecting portion 422 is disposed at a bottom of the shell side plate 421 and extends horizontally in a direction away from the inductor 410. The first connecting portion 422 includes a third connecting hole 4221.

In some embodiments, the inductor box base 440 includes a through hole. A position of the through hole corresponds to a position of the third connecting hole 4221, and a fastener (e.g., a bolt) is inserted through the third connecting hole 4221 and the through hole, so that the inductor box shell 420 and the inductor box base 440 may be fixedly connected.

In some embodiments, as shown in FIG. 7, the inductor box shell 420 includes a plurality of first connecting portions 422, and at least one of the plurality of first connecting portions 422 includes one or more third connecting holes 4221. In some embodiments, the inductor box base 440 includes a plurality of the through holes corresponding to third connecting holes 4221. In this way, it is conducive to improving connection reliability between the inductor box shell 420 and the inductor box base 440.

In some embodiments, as shown in FIG. 5 and FIG. 6, the inductor box cover 430 and the inductor box shell 420 are positioned by means of buckles, and are fixedly connected through fasteners.

For example, referring to FIG. 7, the inductor box shell 420 further includes a top plate 423 (which is called a shell top plate 423) and a clamping portion 424. The shell top plate 423 is fixedly connected to top of the shell side plate 421. The shell top plate 423 includes an extending portion 4231 covering the shell side plate 421. The clamping portion 424 is disposed on the extending portion 4231 of the shell top plate 423.

In some embodiments, the shell side plate 421 and the shell top plate 423 are both sheet metal components, and the shell side plate 421 and the shell top plate 423 are fixedly connected by means of welding. Alternatively, the shell side plate 421 and the shell top plate 423 are both made of acrylonitrile butadiene styrene plastic (ABS), which not only has good insulation performance but also has good fire resistance.

Referring to FIG. 6, the inductor box cover 430 includes a top plate 431 (which is called a cover top plate 431), a side plate 432 (which is called a cover side plate 432) and a buckle 433. The cover top plate 431 is disposed on top of the cover side plate 432. The buckle 433 is disposed on the cover side plate 432, and a position of the buckle 433 corresponds to a position of the clamping portion 424.

For example, referring to FIG. 5, one end of the buckle 433 is fixedly connected to the cover side plate 432, and another end of the buckle 433 extends downward to the position of the clamping portion 424, so as to clamp with the clamping portion 424. Therefore, the inductor box cover 430 may be fixed on the top of the inductor box shell 420, so as to achieve the fixation of the inductor box cover 430 and the inductor box shell 420.

It will be noted that, the inductor box shell 420 includes a plurality of clamping portions 424, the inductor box cover 430 includes a plurality of buckles 433 corresponding to the plurality of clamping portions 424. For example, referring to FIG. 7 and FIG. 8, the inductor box shell 420 includes two clamping portions 424, and the two clamping portions 424 are respectively disposed on two opposite extending portions 4231 of the shell top plate 423. Correspondingly, the inductor box cover 430 includes two buckles 433. The two buckles 433 are respectively clamped with the two clamping portions 424, so that the connection between the inductor box shell 420 and the inductor box cover 430 is more stable.

Figure 8:
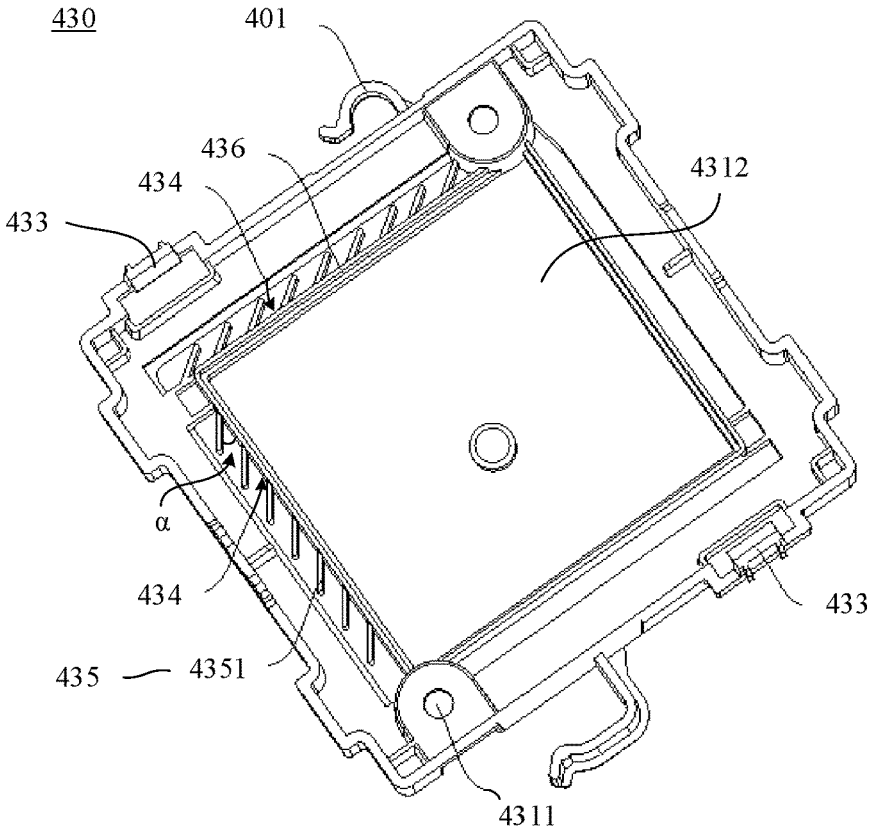
FIG. 8 is a structural diagram of an inductor box cover, in accordance with some embodiments.

In some embodiments, as shown in FIGS. 7 and 8, the shell top plate 423 includes a fourth connecting hole 4232, and the cover top plate 431 includes a fifth connecting hole 4311. A position of the fifth connecting hole 4311 corresponds to a position of the fourth connecting hole 4231, and a fastener is inserted through the fifth connecting hole 4311 and the fourth connecting hole 4231, so that the inductor box shell 420 and the inductor box cover 430 may be fixedly connected to each other.

It will be noted that, the shell top plate 423 may include a plurality of fourth connecting holes 4231, and the cover top plate 431 includes a plurality of fifth connecting holes 4311 corresponding to the plurality of fourth connecting holes 4231.

It can be understood that, in some embodiments of the present disclosure, the inductor box shell 420 and the inductor box cover 430 are fixed through the buckle 433 and the clamping portion 424, and then the inductor box shell 420 and the inductor box cover 430 are fixedly connected by means of a fastener. In this way, the connection between the inductor box shell 420 and the inductor box cover 430 is simplified, so as to facilitate the assembly and disassembly of the inductor assembly 400.

In some embodiments, as shown in FIG. 7, the shell side plate 421 further includes a limiting portion 4211. The limiting portion 4211 protrudes from the shell side plate 421 in a direction away from the inductor 410. In a case where the inductor box shell 420 is fixedly connected to the inductor box cover 430, a lower end of the inductor box cover 430 abuts against the limiting portion 4211. Herein, the limiting portion 4211 and the clamping portion 424 may be located on a same shell side plate 421 or on different shell side plates 421.

It can be understood that, the limiting portion 4211 limits the inductor box cover 430 when the inductor box cover 430 is installed. In addition, the limiting portion 4211 may further play a role of identification during installation of the inductor box cover 430, so as to prevent the connection between the buckle 433 and the clamping portion 424 or between the fourth connecting hole 4231 and the fifth connecting hole 4311 from being misaligned.

In some embodiments, as shown in FIG. 7, the inductor box shell 420 further includes a first heat dissipation opening 425 and a second heat dissipation opening 426. The first heat dissipation opening 425 is disposed on the shell side plate 421, and penetrates through the shell side plate 421 along a thickness direction thereof. The second heat dissipation opening 426 is disposed on the shell top plate 423, and penetrates through the shell top plate 423 along a thickness direction thereof. In this way, heat generated during an operation of the inductor 410 may be discharged from the first heat dissipation opening 425 and the second heat dissipation opening 426.

It will be noted that, the first heat dissipation opening 425 is a strip-shaped through hole. The second heat dissipation opening 426 may be a circular or rectangular through hole, the present disclosure is not limited thereto.

In some embodiments, the inductor box shell 420 includes a plurality of first heat dissipation openings 425, and the plurality of first heat dissipation openings 425 are arranged at intervals along a height direction of the inductor box shell 420.

In some embodiments, referring to FIG. 7, the inductor box shell 420 further includes a plurality of first water blocking portions 427. The plurality of first water blocking portions 427 correspond to the plurality of first heat dissipation openings 425. Each first water blocking portion 427 extends from an upper edge of the first heat dissipation opening 425 to an outer side of the inductor box shell 420 and downward, so as to shield the first heat dissipation opening 425. Thus, it is possible to prevent rainwater from entering the inductor assembly 400 through the first heat dissipation opening 425 without affecting the heat dissipation.

In some embodiments, as shown in FIG. 7, the inductor box shell 420 includes a plurality of shell side plates 421, and the plurality of first heat dissipation openings 425 are disposed on at least two adjacent shell side plates 421 of the plurality of shell side plates 421, which is conducive to providing air convection in the inductor assembly 400 and improving the heat dissipation efficiency of the inductor 410.

Figure 9:
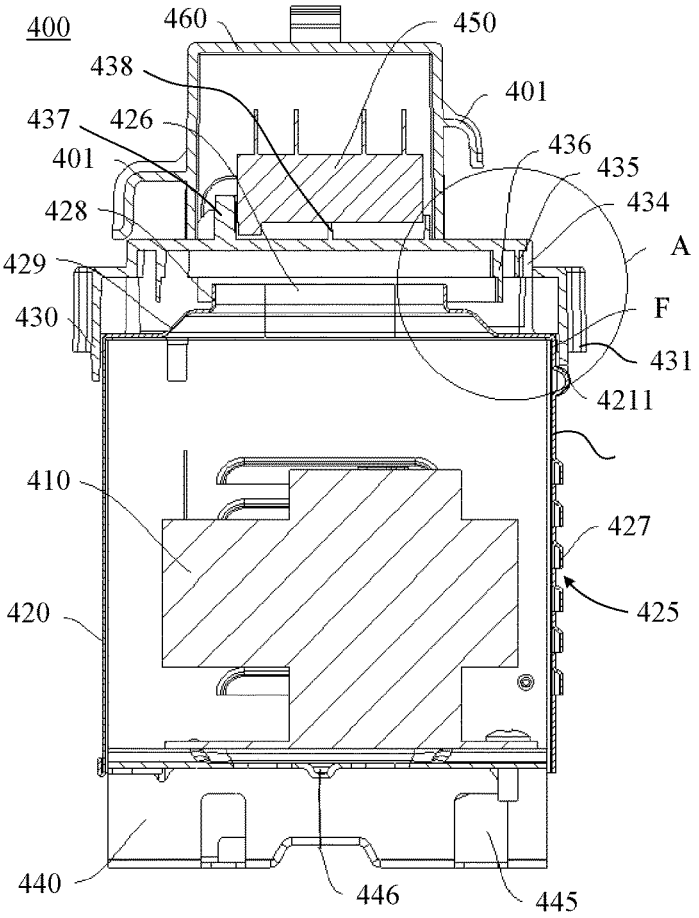
FIG. 9 is a sectional view of an inductor assembly, in accordance with some embodiments.
Figure 10:
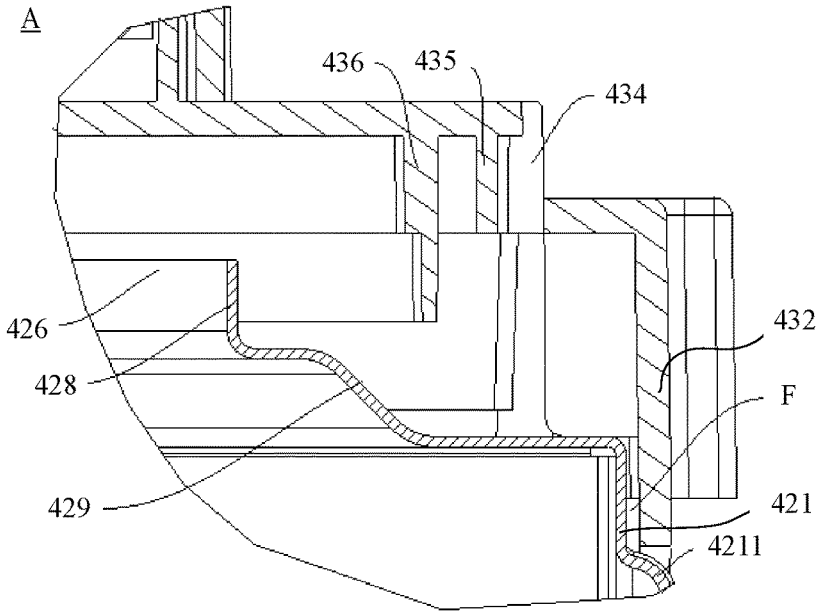
FIG. 10 is a partial enlarged view of the circle A in FIG. 9.

In some embodiments, as shown in FIGS. 8 to 10, the inductor box cover 430 further includes a third heat dissipation opening 434 and a second water blocking portion 435. The third heat dissipation opening 434 communicates with the second heat dissipation opening 426. In this way, a part of the heat generated by the inductor 410 during operation may enter the inductor box cover 430 through the second heat dissipation opening 426, and then be discharged from the inductor assembly 400 through the third heat dissipation opening 434, which is conducive to improving the heat dissipation efficiency of the inductor 410. The second water blocking portion 435 is disposed at the third heat dissipation opening 434, and is configured to prevent rainwater from entering the inductor assembly 400 through the third heat dissipation opening 434, so that reliability of operation of the inductor 410 in rainy days is ensured.

For example, referring to FIGS. 6 and 8, the cover top plate 431 includes a third protruding portion 4312 extending upward. The third heat dissipation opening 434 is disposed on a side surface of the third protruding portion 4312. That is, an opening direction of the third heat dissipation opening 434 is substantially perpendicular to a height direction of the inductor assembly 400.

In some embodiments, referring to FIG. 8, the third heat dissipation opening 434 is a strip-shaped through hole extending in the horizontal direction. The second water blocking portion 435 includes a plurality of water blocking ribs 4351, and the plurality of water blocking ribs 4351 are parallel to each other, and arranged at intervals along a length direction of the third heat dissipation opening 434. Each of the plurality of water blocking ribs 4351 is welded and fixed to an upper edge and a lower edge of the third heat dissipation opening 434, and has a preset angle $\alpha$ with a plane where the third heat dissipation opening 434 is located. In this way, an impact strength of rainwater on the second water blocking portion 435 may be reduced, and a waterproof effect of the second water blocking portion 435 may be improved without affecting the heat dissipation of the inductor 410.

In some embodiments, a degree of the preset angle $\alpha$ between the water blocking rib 4351 and the plane where the third heat dissipation opening 434 is located is any value in a range of 30° to 60° inclusive. For example, the degree of the preset angle $\alpha$ may be set as 30°, 40°, 45°, 55°, or 60°.

It can be understood that, in a case where the degree of the preset angle $\alpha$ is large (e.g., greater than 60° and less than 90°), the heat dissipation performance of the inductor assembly 400 may be improved, but the rainproof performance of the inductor assembly 400 may be reduced. In a case where the degree of the preset angle $\alpha$ is small (e.g., less than 30°, the water blocking ribs 4351 may shield the third heat dissipation opening 434 well, but the heat dissipation performance of the inductor assembly 400 may be reduced. Therefore, in the present disclosure, the degree of the preset angle $\alpha$ is set as any value in the range of 30° to 60° inclusive, so that the inductor assembly 400 may have both good heat dissipation performance and good waterproof performance.

FIG. 9 is a sectional view of an inductor assembly, in accordance with some embodiments. FIG. 10 is a partial enlarged view of the circle A in FIG. 9.

In some embodiments, as shown in FIGS. 9 and 10, there is a gap F between the shell side plate 421 and the cover side plate 432. In this way, in a case where the rainwater enters the inductor box cover 430 through the third heat dissipation opening 434, the rainwater is discharged from the inductor box cover 430 through the gap F due to gravity, which is conducive to improving the waterproof performance of the inductor assembly 400.

In some embodiments, as shown in FIGS. 8 to 10, the inductor box cover 430 further includes a third water blocking portion 436. The third water blocking portion 436 is disposed on an inner surface (i.e., a lower surface) of the cover top plate 431, and is located between the second heat dissipation opening 426 and the third heat dissipation opening 434. A height of the third water blocking portion 436 is greater than that of the second water blocking portion 435, and the third water blocking portion 436 is closer to the second heat dissipation opening 426 than the second water blocking portion 435.

For example, referring to FIG. 8, the third water blocking portion 436 may be configured as an annular. An upper end in an axial direction of the third water blocking portion 436 is connected to the cover top plate 431, and a lower end in the axial direction of the third water blocking portion 436 extends downward to exceed a horizontal plane where the second heat dissipation opening 426 is located. An orthogonal projection of the third water blocking portion 436 on the horizontal plane where the second heat dissipation opening 426 is located is a rectangular ring, and the second heat dissipation opening 426 on the horizontal plane where the second heat dissipation opening 426 is located is within the rectangular ring. In this way, when the rainwater enters the inductor box cover 430 through the third heat dissipation opening 434, the rainwater is blocked by the third water blocking portion 436 and fall on the shell top plate 423, and is discharged from the gap F due to gravity. Therefore, the rainproof capability of the inductor assembly 400 may be improved.

In some embodiments, as shown in FIGS. 7 and 9, the inductor box shell 420 further includes a fourth water blocking portion 428. The fourth water blocking portion 428 surrounds the second heat dissipation opening 426 and extends upward. At least a part of the fourth water blocking portion 428 extends to an inner side of the third water blocking portion 436. That is, with reference to the horizontal plane where the second heat dissipation opening 426 is located, a distance between an upper end of the fourth water blocking portion 428 and the reference plane is greater than a distance between the lower end of the third water blocking portion 436 and the reference plane. In this way, the rainwater entering the inductor box cover 430 from the third heat dissipation opening 434 may be effectively prevented from entering the inductor box shell 420 through the second heat dissipation opening 426, so that an operating stability of the inductor assembly 400 in rainy days may be improved.

In some embodiments, as shown in FIGS. 7 and 9, the inductor box shell 420 further includes a waterproof boss 429. The shell top plate 423 protrudes upward at a position proximate to the second heat dissipation opening 426, so as to form the waterproof boss 429. An upper end of the waterproof boss 429 is connected to a lower end of the fourth water blocking portion 428, and a size of the upper end of the waterproof boss 429 is smaller than that of the lower end of the waterproof boss 429. In this way, the rainwater entering the inductor box cover 430 from the third heat dissipation opening 434 may flow to the gap F along the waterproof boss 429, and be discharged from the inductor assembly 400 through the gap F.

It can be understood that, a shape of the waterproof boss 429 matches that of the second heat dissipation opening 426. For example, if the second heat dissipation opening 426 is in a shape of a circle, the waterproof boss 429 is substantially in a shape of a hollow frustum of a cone. An inner diameter of a ring enclosed by an upper end of the hollow truncated cone is smaller than that of a ring enclosed by a lower end of the hollow truncated cone. Alternatively, if the second heat dissipation opening 426 is in a shape of a rectangle, the waterproof boss 429 is substantially a hollow frustum of a pyramid. Length and width of a rectangular ring formed by an upper end of the hollow square frustum are respectively smaller than that of a rectangular ring formed by a lower end of the hollow square frustum.

In some embodiments, as shown in FIGS. 9 and 11, the inductor box base 440 further includes a first air inlet 444, a second air inlet 445 and an air inlet groove 446. The air outside the inductor box base 440 may enter the inductor box base 440 through the first air inlet 444, the second air inlet 445 and the air inlet groove 446, carry the heat dissipated by the inductor 410, and be discharged from the inductor assembly 400 through the first heat dissipation opening 425 or the third heat dissipation opening 434, thereby achieving heat dissipation of the inductor 410.

For example, the first air inlet 444 is disposed on the base body 441 and located below the inductor 410. The second air inlet 445 is disposed on a side plate of the base body 441. The base body 441 is recessed downward (as shown in FIG. 9), so as to form an air inlet groove 446. One end of the air inlet groove 446 is communicated with an outer space of the inductor assembly 400, and another end of the air inlet groove 446 is communicated with the first air inlet 444. In this way, airflow may enter the inductor assembly 400 through the first air inlet 444 and the second air inlet 445, so as to take away the heat generated by the inductor 410 from different orientations.

For example, airflow may enter the inductor assembly 400 from the first air inlet 444, so as to cool the inductor 410 from an underside of the inductor 410. Alternatively, airflow may enter the inductor assembly 400 from the second air inlet 445, so as to cool the inductor 410 from a side of the inductor 410.

As shown in FIG. 11, the inductor box base 440 includes two first air inlets 444, four second air inlets 445 and two air inlet grooves 446.

In some embodiments, as shown in FIGS. 6 and 9, the inductor assembly 400 further includes a terminal block 450. The terminal block 450 is fixedly connected to the cover top plate 431. In some embodiments, the inductor box cover 430 further includes a limiting rib 437 and a first connecting column 438. The limiting rib 437 extends upward from an upper surface of the cover top plate 431. The limiting rib 437 is in a shape of a rectangular ring, and an outer contour of a lower end of the terminal block 450 matches an inner contour of the limiting rib 437. That is, the terminal block 450 is embedded in the limiting rib 437, so that the terminal block 450 and the inductor box cover 430 may be fixed.

The first connecting column 438 extends upward from the upper surface of the cover top plate 431 and located inside the limiting rib 437. The first connecting column 438 is a hollow cylinder with internal threads on its inner surface. The terminal block 450 includes a sixth connecting hole 451 whose position is corresponding to a position of the first connecting column 438. A fastener is inserted through the sixth connecting hole 451 and connected to the first connecting column 438, so as to achieve the fixed connection between the terminal block 450 and the inductor box cover 430.

In some embodiments, referring to FIGS. 5, 6 and 9, the inductor assembly 400 further includes an outer cover 460. The outer cover 460 is substantially in a shape of a hollow cuboid, and a side of the outer cover 460 facing the inductor box cover 430 is open. The outer cover 460 is fixedly connected to the inductor box cover 430, and covers the terminal block 450. In this way, the terminal block 450 may be prevented from being wetted by rainwater.

For example, referring to FIGS. 5 and 6, the outer cover 460 includes a second connecting portion 461. The second connecting portion 461 is disposed on a side plate of the outer cover 460, and extends from the side plate of the outer cover 460 in a direction away from the outer cover 460. The second connection portion 461 includes a seventh connecting hole 4611. The seventh connecting hole 4611 penetrates through the second connecting portion 461 along a thickness direction (i.e., the up-down direction) thereof. In some embodiments, the inductor box cover 430 further includes a second connecting column 439. The second connecting column 439 extends upward from the upper surface of the cover top plate 431 and a position of the second connecting column 439 corresponds to a position of the seventh connecting hole 4611. The second connecting column 439 is a hollow cylinder with internal threads on its inner surface. A fastener is inserted through the seventh connecting hole 4611 and connected to the second connecting column 439, so that the outer cover 460 and the inductor box cover 430 may be fixedly connected to each other.

In some embodiments, as shown in FIGS. 5 and 6, the inductor assembly 400 further includes a wire clip 401. The wire clip 401 is disposed on the inductor box cover 430 or the outer cover 460.

For example, referring to FIG. 6, the inductor assembly 400 includes a plurality of wire clips 401, a first wire clip 401A of the plurality of wire clips 401 is disposed on the cover side plate 432, a second wire clip 401B of the plurality of wire clips 401 is disposed on the side plate of the outer cover 460, and a third wire clip 401C of the plurality of wire clips 401 is provided on a top plate of the outer cover 460.

It can be understood that, power wires and signal wires of the inductor assembly 400 may be fixed by winding on the plurality of wire clips 401, so that the power wires and the signal wires may be prevented from being damaged by external force, and wiring of the inductor assembly 400 may be made orderly.

In some embodiments, the inductor box cover 430 and the outer cover 460 are both plastic members, so that the inductor 410 and terminals in the terminal block 450 may be insulated. For example, the inductor box cover 430 and the outer cover 460 are made of ABS, so as to have the good insulation performance and the good fire resistance.

<Mounting Member>

In some embodiments, as shown in FIGS. 2A and 2B, the indoor unit 100 includes a mounting member 120. At least a part of the mounting member 120 is attached to a side plate of the indoor air duct component 110 proximate to the outdoor air duct component 210 through a fastener, and a lower end of the mounting member 120 is fixedly connected to the base 300. The inductor assembly 400 is fixedly connected to an upper portion of the mounting member 120 by means of a fastener, so that the inductor assembly 400 may be spaced apart from the base 300 by a preset distance D.

For example, referring to FIGS. 2A and 2B, the mounting member 120 includes a first mounting plate 121, and the indoor air duct component 110 includes a first plate 111. The first plate 111 is a side plate of the indoor air duct component 110 proximate to the outdoor air duct component 210. The first mounting plate 121 is attached to the first plate 111 and fixedly connected to the first plate 111. The inductor assembly 400 is fixedly connected to an upper portion of the first mounting plate 121.

In some embodiments, the mounting member 120 further includes a second mounting plate 122. The second mounting plate 122 and the first mounting plate 121 are connected to each other and form an angle (e.g., 90°. In some embodiments, the indoor air duct component 110 further includes a second plate 112. The second plate 112 is a left side plate or a right side plate of the indoor air duct component 110. The second mounting plate 122 is attached to the second plate 112 and fixedly connected to the second plate 112. In this way, it is possible to improve a stability of the connection between the mounting member 120 and the indoor air duct component 110.

In some embodiments, the indoor air duct component 110 is a foam member, and the mounting member 120 is a plastic member or a metal member, which is conducive to reducing the cost of the air conditioner 1.

<First Mounting Groove>

In some embodiments, as shown in FIGS. 2A and 2B, the indoor unit 100 further includes a first mounting groove 130 (i.e., mounting groove). The first mounting groove 130 is disposed on a side of the indoor air duct component 110 proximate to the outdoor air duct component 210, and a position of the first mounting groove 130 corresponds to a position of the compressor 1011. The first mounting groove 130 extends upward from the base 300 and does not penetrate through the indoor air duct component 110, so that an upper end of the first mounting groove 130 has a shielding portion. The inductor assembly 400 is fixedly installed in the first mounting groove 130 and is spaced apart from each groove wall of the first mounting groove 130, so as to improve the heat dissipation performance and waterproof performance of the inductor assembly 400.

<Electrical Control Assembly>

In some embodiments, as shown in FIGS. 2A to 4, the main body 101 further includes an electrical control assembly 1012. The electrical control assembly 1012 is located at upper portions of the indoor air duct component 110 and the outdoor air duct component 210. One end of the electrical control assembly 1012 proximate to the indoor air duct component 110 is fixedly connected to a top plate of the indoor air duct component 110, and another end of the electrical control assembly 1012 proximate to the outdoor air duct component 210 is fixedly connected to a top plate of the outdoor air duct component 210. A distance between a lower surface of the electrical control assembly 1012 and the base 300 is greater than a distance between an upper surface of the inductor assembly 400 and the base 300. In this way, there is a certain gap between the electrical control assembly 1012 and the inductor assembly 400, which is conducive to improving the heat dissipation efficiency of the inductor assembly 400.

<Fan Assembly>

Figure 13:
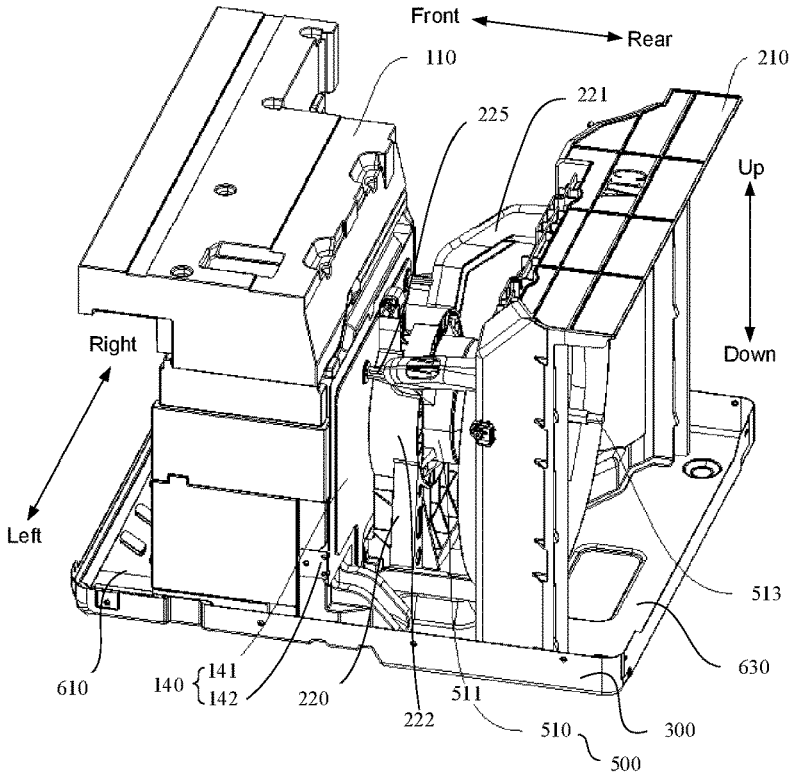
FIG. 13 is yet another perspective view of a main body, in accordance with some embodiments.

In some embodiments, as shown in FIG. 13, the main body 101 further includes a fan assembly 500. In this case, the outdoor unit 200 further includes a motor mounting frame 220, and the motor mounting frame 220 is fixedly connected to a side (i.e., the front side) of the outdoor air duct component 210 proximate to the indoor air duct component 110. The fan assembly 500 is fixedly connected to the motor mounting frame 220.

Figure 12A:
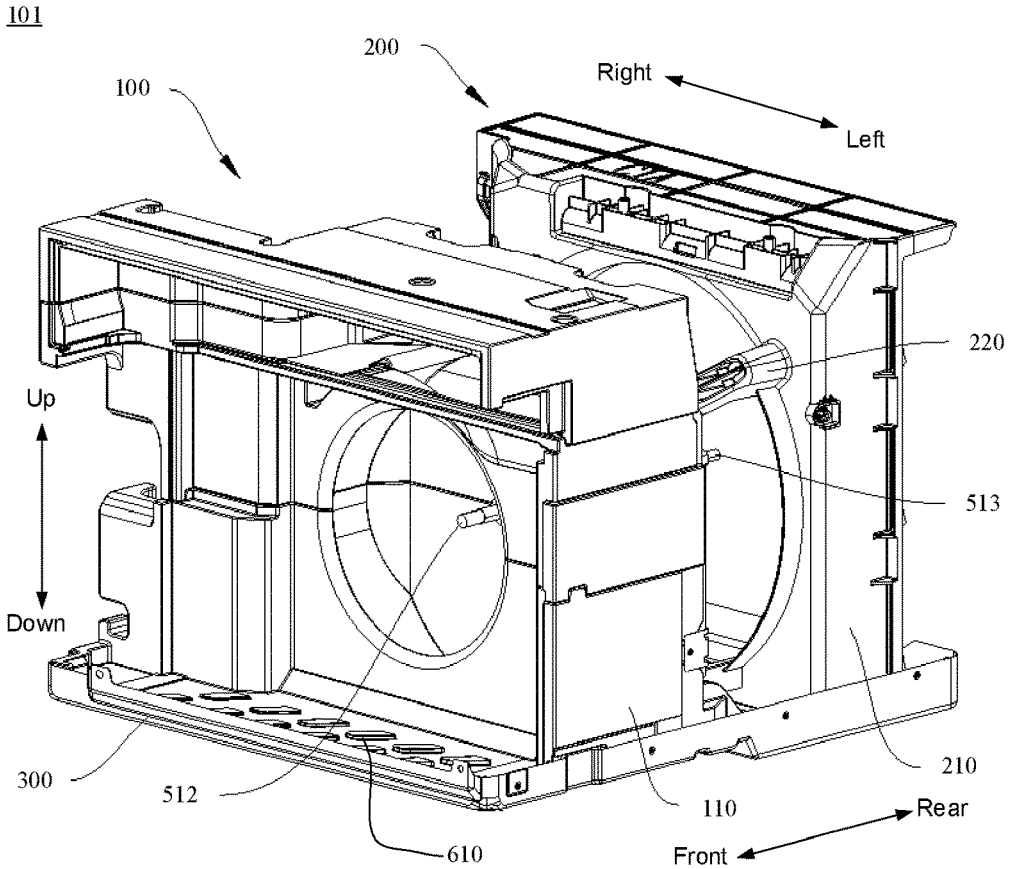
FIG. 12A is a perspective view of a main body with a first fan and a second fan removed, in accordance with some embodiments.
Figure 12B:
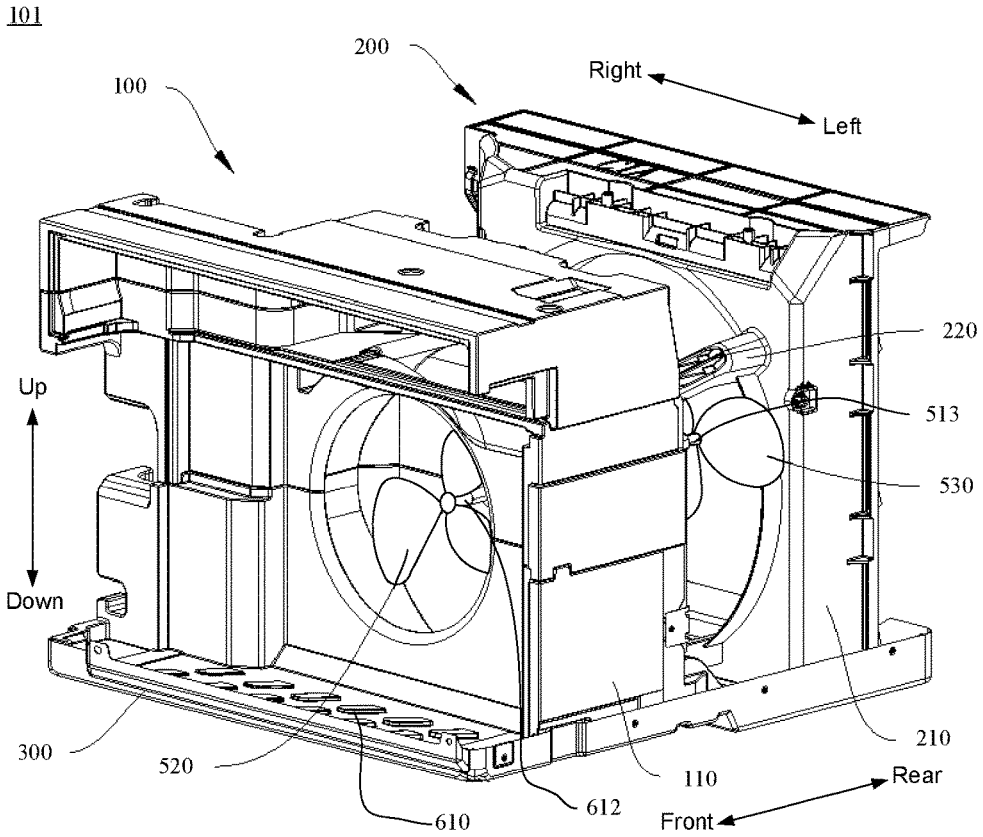
FIG. 12B is a perspective view of a main body with a first fan and a second fan, in accordance with some embodiments.

FIG. 12A is a perspective view of a main body with a first fan and a second fan removed, in accordance with some embodiments. FIG. 12B is a perspective view of a main body with a first fan and a second fan, in accordance with some embodiments. FIG. 13 is yet another perspective view of a main body, in accordance with some embodiments.

For example, referring to FIGS. 12A, 12B and 13, the fan assembly 500 includes a motor component 510, a first fan 520 and a second fan 530. The first fan 520 and the second fan 530 are respectively connected to two output shafts of the motor component 510. For example, the motor component 510 includes a motor 511, a first output shaft 512 and a second output shaft 513. One end of the first output shaft 512 is connected to the motor 511, and another end of the first output shaft 512 is located in the indoor air duct component 110 and connected to the first fan 520. One end of the second output shaft 513 is connected to the motor 511, and another end of the second output shaft 513 is located in the outdoor air duct component 210 and connected to the second fan 530.

In this way, the motor 511 may drive the first output shaft 512 and the second output shaft 513, so as to drive the first fan 520 and the second fan 530. The first fan 520 is configured to guide indoor air to the indoor heat exchanger, make the air exchange heat with the indoor heat exchanger, and blow out the heat-exchanged air from the indoor air duct component 110 to the indoor. The second fan 530 is configured to guide the outdoor air to the outdoor heat exchanger, make the air exchange heat with the outdoor heat exchanger, and blow out the heat-exchanged air from the outdoor air duct component 210 to the outdoor.

It will be noted that, the first output shaft 512 and the second output shaft 513 may rotate synchronously, or may rotate independently, but the present disclosure is not limited thereto.

Figure 14:
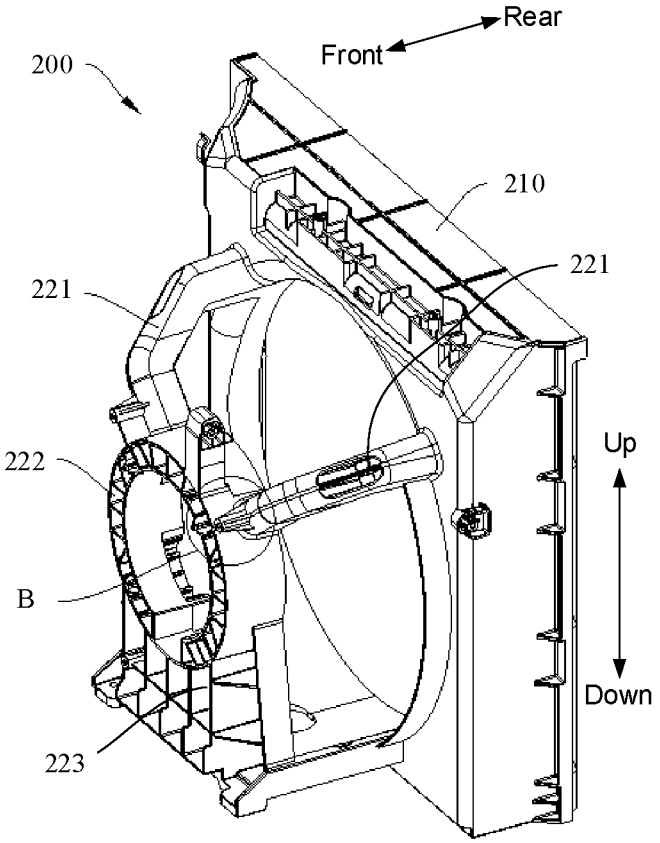
FIG. 14 is a perspective view of an outdoor unit, in accordance with some embodiments.

FIG. 14 is a perspective view of an outdoor unit, in accordance with some embodiments. As shown in FIG. 14, in some embodiments, the motor mounting frame 220 includes a connecting arm 221 and a fixing ring 222. One end of the connecting arm 221 is connected to a front side plate of the outdoor air duct component 210, and another end of the connecting arm 221 is connected to the fixing ring 222. Referring to FIG. 13, a side of an axial direction of the fixing ring 222 faces the indoor air duct component 110, and another side in the axial direction of the fixing ring 222 faces the outdoor air duct component 210. The motor 511 is inserted through the fixing ring 222 and fixedly connected to the fixing ring 222.

In some embodiments, as shown in FIG. 14, the motor mounting frame 220 includes a plurality of connecting arms 221, and the plurality of connecting arms 221 are arranged at intervals along a direction surrounding a central axis of the fixing ring 222 and are fixedly connected to the fixing ring 222, so as to increase the stability of the fixing ring 222.

In some embodiments, as shown in FIG. 14, the motor mounting frame 220 further includes a fixing ring bracket 223. An upper end of the fixing ring bracket 223 is fixedly connected to a peripheral plate of the fixing ring 222. A lower end of the fixing ring bracket 223 is fixedly connected to the base 300, and a rear end of the fixing ring bracket 223 is fixedly connected to the outdoor air duct component 210.

For example, the fixing ring bracket 223 and the fixing ring 222 are fixedly connected by means of welding. The fixing ring bracket 223 and the base 300 are connected by means of fasteners. The fixing ring bracket 223 and the outdoor air duct component 210 are connected by means of fasteners.

<Sound Insulating Member>

In some embodiments, as shown in FIG. 13, the indoor unit 100 further includes a sound insulating member 140. The sound insulating member 140 is attached to a part of the first plate 111 of the indoor air duct component 110. A density of the sound insulating member 140 is greater than that of the indoor air duct component 110.

It can be understood that, when the air conditioner 1 is operating, the second fan 530 generates noise, and the noise is prone to transmit to the indoor through the indoor air duct component 110. Therefore, by providing the sound insulating member 140 on the first plate 111 with the density greater than that of the indoor air duct component 110, the noise generated by the second fan 530 during rotation may be blocked, which is conducive to improving experience of the user.

In some embodiments, the indoor air duct component 110 further includes an indoor heat exchange air duct, and at least a part of the sound insulating member 140 covers a part of the first plate 111 corresponding to the indoor heat exchange air duct.

In this way, by providing the sound insulating member 140 to cover at least the part of the first plate 111 corresponding to the indoor heat exchange air duct, a transmission path of the noise may be extended when the noise generated by the second fan 530 bypasses the sound insulating member 140 and is transmitted in a direction to the indoor along an edge of the indoor air duct component 110, so that a volume of the noise transmitted into the indoor may be reduced, which is conducive to improving the sound insulating effect.

In some embodiments, the sound insulating member 140 includes a sheet metal component, and a density of the sheet metal component is high, so that the sound insulating member 140 has good sound insulating performance. Alternatively, the sound insulating member 140 may also be made of other sound insulating materials with high density, the present disclosure is not limited thereto.

Figure 16:
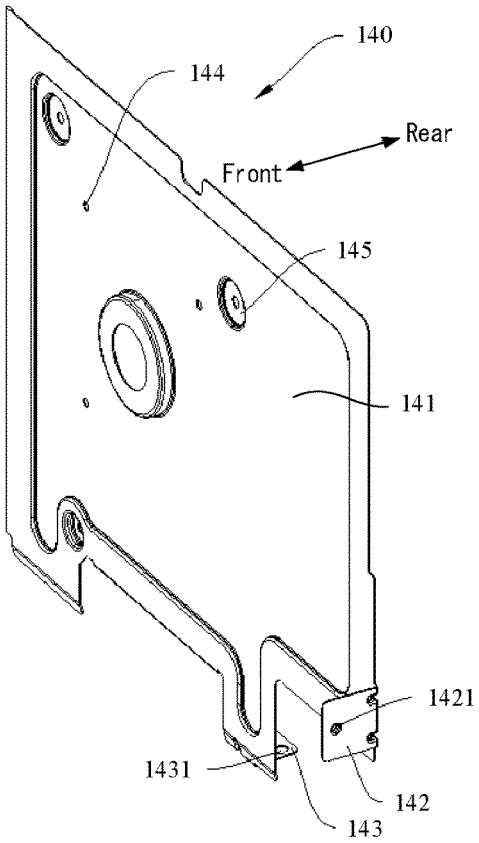
FIG. 16 is a perspective view of a sound insulating member, in accordance with some embodiments.

In some embodiments, as shown in FIGS. 13 and 16, the sound insulating member 140 includes a sound insulating plate 141 and a first fixing plate 142. The sound insulating plate 141 is attached to a part of the first plate 111 of the indoor air duct component 110. A left end of the sound insulating plate 141 is coplanar with a left surface of the indoor air duct component 110, and the first fixing plate 142 extends forward along the left end of the sound insulating plate 141. That is, the first fixing plate 142 is attached to the left surface of the indoor air duct component 110. The first fixing plate 142 is fixedly connected to the left side plate of the indoor air duct component 110.

For example, the first fixing plate 142 includes an eighth connecting hole 1421, and the eighth connecting hole 1421 penetrates through the first fixing plate 142 along a thickness direction thereof. A first connecting portion is provided on the left side plate of the indoor air duct component 110 at a position corresponding to the eighth connecting hole 1421. A fastener is inserted through the eighth connecting hole 1421 and the first connecting portion, thereby fixing the first fixing plate 142 to the left side plate of the indoor air duct component 110, which is conducive to improving a reliability of the installation of the sound insulating member 140.

In some embodiments, as shown in FIG. 16, the sound insulating member 140 further includes a second fixing plate 143. The second fixing plate 143 extends from a lower side of the sound insulating plate 141 to a lower side of the fixing ring bracket 223, and is fixedly connected to the bottom plate of the fixing ring bracket 223.

For example, the second fixing plate 143 includes a ninth connecting hole 1431, and the ninth connecting hole 1431 penetrates through the second fixing plate 143 along a thickness direction thereof. A second connecting portion is provided on the bottom plate of the fixing ring bracket 223 at a position corresponding to the ninth connecting hole 1431. A fastener is inserted through the ninth connecting hole 1431 and the second connecting portion, so as to fixedly connect the second fixing plate 143 to the bottom plate of the fixing ring bracket 223, thereby achieving a fixed connection between the sound insulating member 140 and the motor mounting frame 220.

Figure 15:
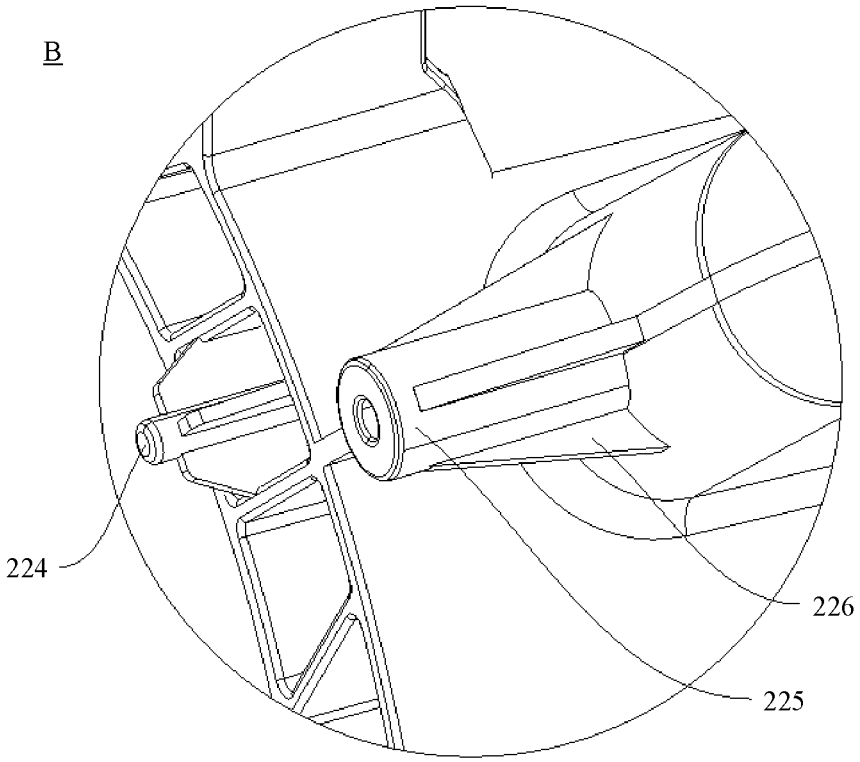
FIG. 15 is a partial enlarged view of the circle B in FIG. 14.

FIG. 15 is a partial enlarged view of the circle B in FIG. 14. FIG. 16 is a perspective view of a sound insulating member, in accordance with some embodiments.

In some embodiments, as shown in FIGS. 13, 15 and 16, the sound insulating member 140 is further fixedly connected to the motor mounting frame 220.

For example, the motor mounting frame 220 further includes a positioning member 224, and the positioning member 224 extends from a surface of the fixing ring 222 proximate to the sound insulating member 140 in a direction proximate to the sound insulating member 140. The sound insulating member 140 further includes a first positioning portion 144. A position of corresponds to a position of the positioning member 224 and the first positioning portion 144 is matched with the positioning member 224. The motor mounting frame 220 may be connected to the sound insulating member 140 by inserting the positioning member 224 in the first positioning portion 144.

In some embodiments, referring to FIGS. 15 and 16, the motor mounting frame 220 includes a plurality of positioning members 224. The sound insulating member 140 includes a plurality of first positioning portions 144 corresponding to the plurality of positioning members 224. Each positioning member 224 is inserted into the corresponding first positioning portion 144, so that the reliability of the connection between the motor mounting frame 220 and the sound insulating member 140 may be improved.

For example, the positioning member 224 is a positioning column, and the first positioning portion 144 is a positioning hole. Positioning between the motor mounting frame 220 and the sound insulating member 140 may be achieved by inserting the positioning column in the positioning hole.

In some embodiments, as shown in FIGS. 13 and 15, the motor mounting frame 220 further includes a third connecting column 225. The third connecting column 225 extends from a surface of the connecting arm 221 proximate to the sound insulating member 140 toward a direction proximate to the sound insulating member 140. As shown in FIG. 16, the sound insulating member 140 further includes a tenth connecting hole 145. The tenth connecting hole 145 penetrates through the sound insulating plate 141 along a thickness direction thereof and a position of the tenth connecting hole 145 corresponds to the position of the positioning member 224. The indoor air duct component 110 further includes a third connecting portion. The third connecting portion penetrates through the first plate 111 along a thickness direction thereof and a position of the third connecting portion corresponds to a position of the tenth connecting hole 145.

It can be understood that, a fastener is inserted through the third connecting portion, the tenth connecting hole 145 and the third connecting column 225 in sequence, so that the indoor air duct component 110, the sound insulating member 140 and the motor mounting frame 220 may be fixedly connected to each other.

In some embodiments, as shown in FIG. 15, the motor mounting frame 220 further includes a plurality of first reinforcing ribs 226. The plurality of first reinforcing ribs 226 are connected to the third connecting column 225 and are arranged at intervals along a circumferential direction of the third connecting column 225. Each first reinforcing rib 226 is further connected to the corresponding connecting arm 221, so that a structural strength of the third connecting column 225 may be improved.

In some embodiments, the motor mounting frame 220 includes a plurality of third connecting columns 225. The sound insulating member 140 includes a plurality of tenth connecting holes 145 corresponding to the plurality of third connecting columns 225. The indoor air duct component 110 includes a plurality of third connecting portions corresponding to the plurality of tenth connecting holes 145. In this way, connecting reliability of the indoor air duct component 110, the sound insulating member 140 and the motor mounting frame 220 may be improved.

<Fresh Air Duct>

Figure 19:
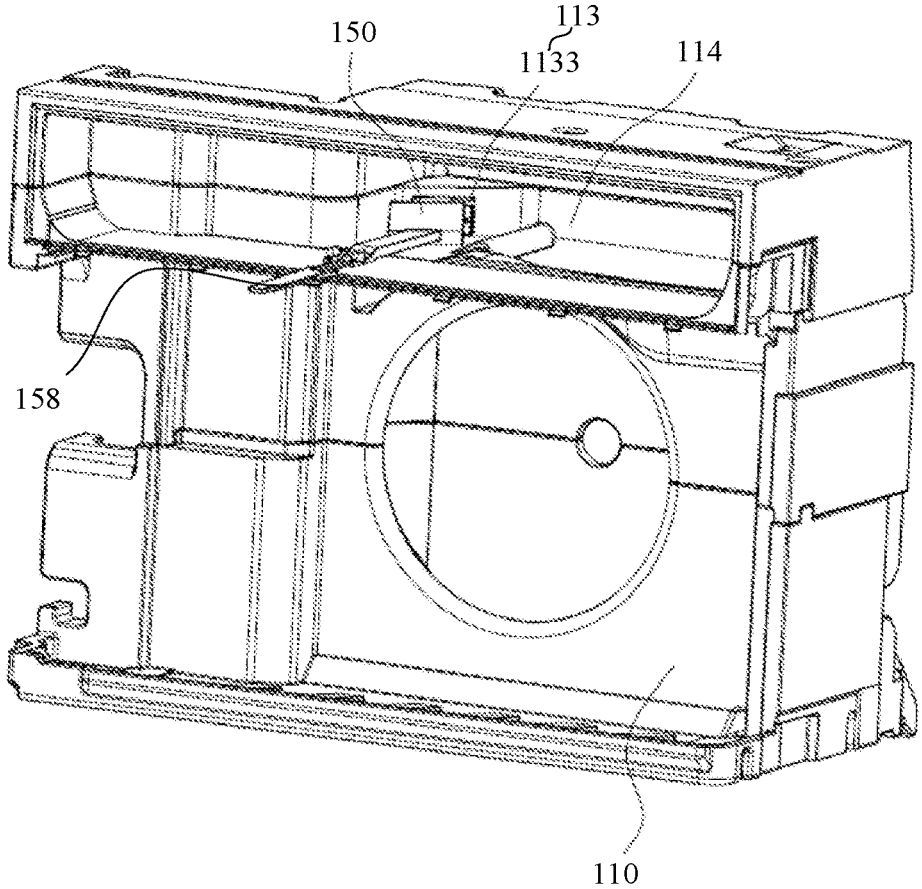
FIG. 19 is another perspective view of an indoor unit, in accordance with some embodiments.
Figure 21:
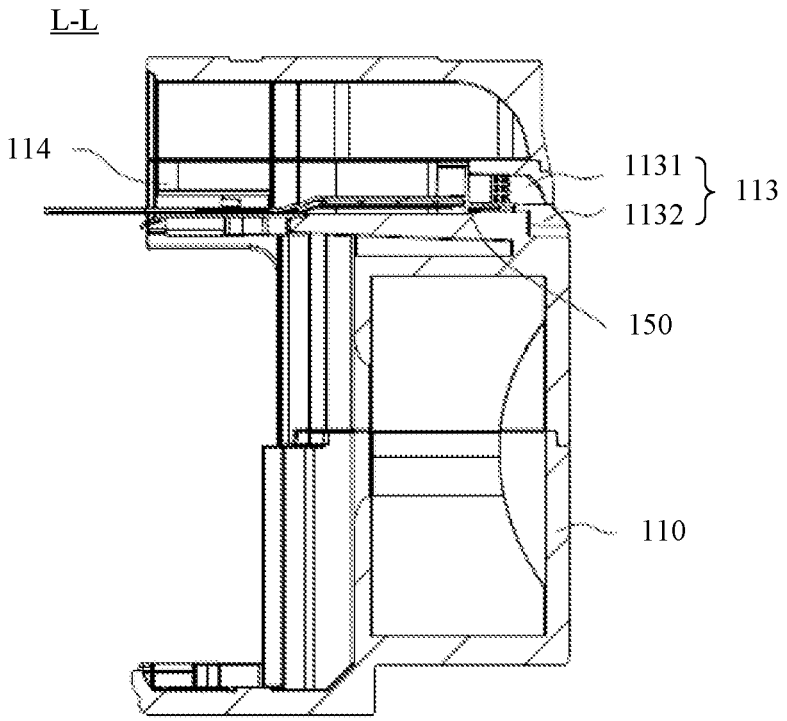
FIG. 21 is a cross-sectional view taken along the line L-L in FIG. 20.

In some embodiments, as shown in FIGS. 19 and 21, the indoor air duct component 110 further includes a fresh air duct 113 and an air outlet 114. The air outlet 114 is disposed on a side plate of the indoor air duct component 110 away from the outdoor air duct component 210. The fresh air duct 113 is disposed at a rear portion of the indoor air duct component 110 and corresponds to a position of the air outlet 114. The fresh air duct 113 communicates with the indoor through the air outlet 114, so that the outdoor fresh air may enter the indoor through the fresh air duct 113 and the air outlet 114.

In some embodiments, as shown in FIG. 21, the fresh air duct 113 includes a first air duct segment 1131, a second air duct segment 1132, a fresh air duct outlet 1133 (referring to FIG. 19), and a fresh air duct inlet. One end of the first air duct segment 1131 communicates with the air outlet 114 through the fresh air duct outlet 1133. Another end of the first air duct segment 1131 is located at a rear portion of the indoor air duct component 110, and is connected to one end of the second air duct segment 1132. Another end of the second air duct segment 1132 extends downward, so as to communicate with the fresh air duct inlet.

It can be understood that, the first air duct segment 1131 is arranged horizontally, and the second air duct segment 1132 extends downward and forms a certain angle (e.g., 90°) with the first air duct segment 1131. With such arrangement, rainwater may be prevented from entering the first air duct segment 1131 through the second air duct segment 1132, and then entering the indoor through the first air duct segment 1131.

<Fresh Air Member>

Figure 17A:
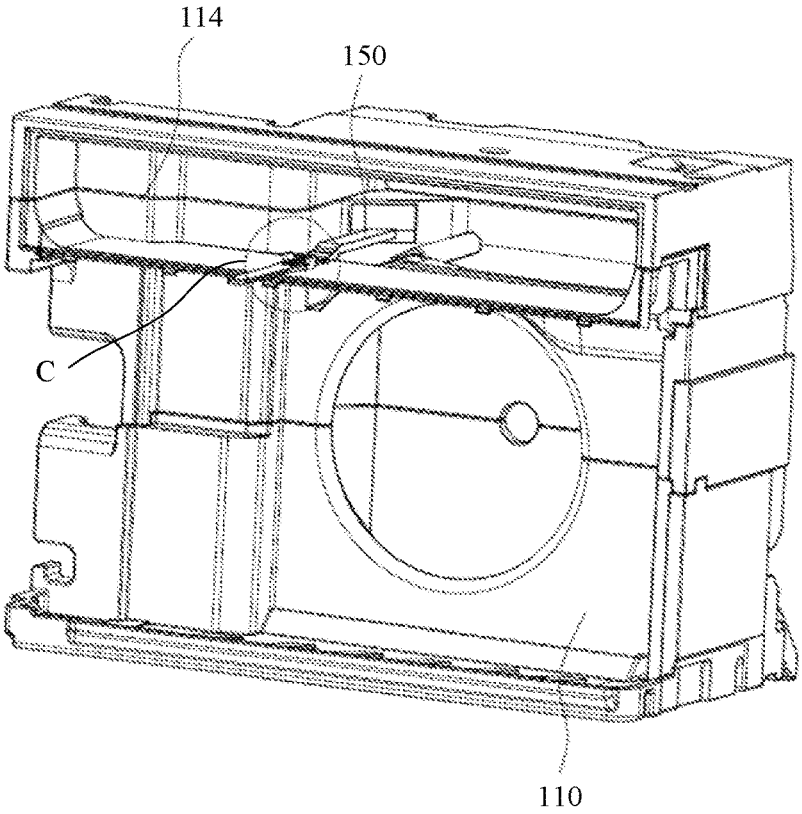
FIG. 17A is a perspective view of an indoor unit, in accordance with some embodiments.
Figure 17B:
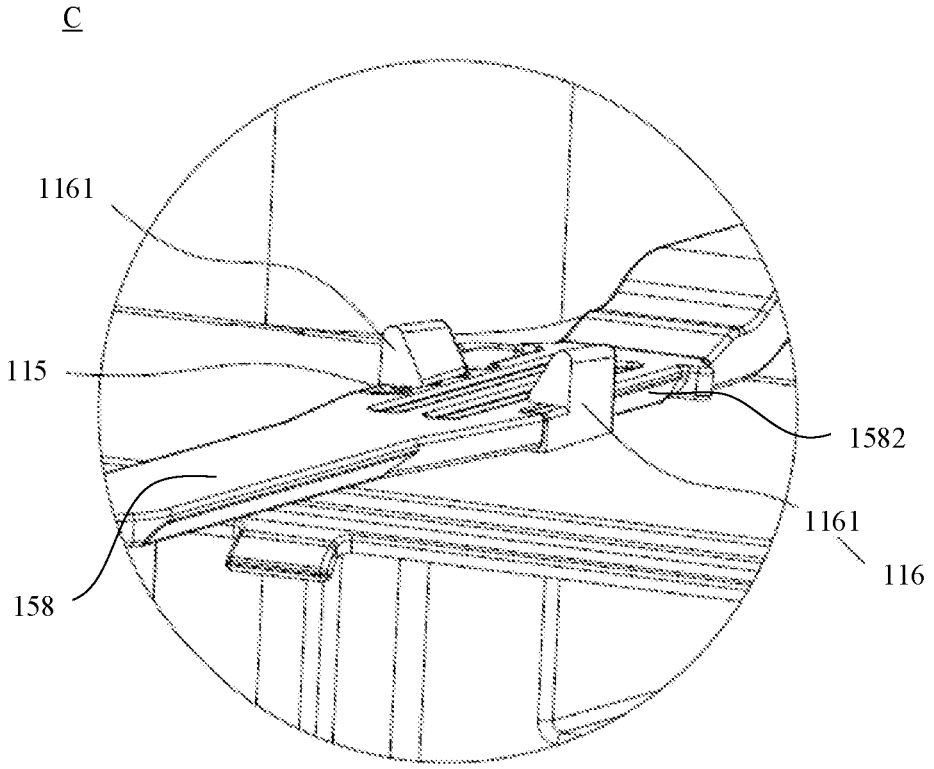
FIG. 17B is a partial enlarged view of the circle C in FIG. 17A.

FIG. 17A is a perspective view of an indoor unit, in accordance with some embodiments. FIG. 17B is a partial enlarged view of the circle C in FIG. 17A. FIG. 19 is another perspective view of an indoor unit, in accordance with some embodiments.

In some embodiments, as shown in FIGS. 17A and 19, the indoor unit 100 further includes a fresh air member 150. The fresh air member 150 is inserted into the fresh air duct 113 through the fresh air duct outlet 1133. The fresh air member 150 is relatively slidable in the fresh air duct 113, so as to open or close the fresh air duct 113.

Figure 20:
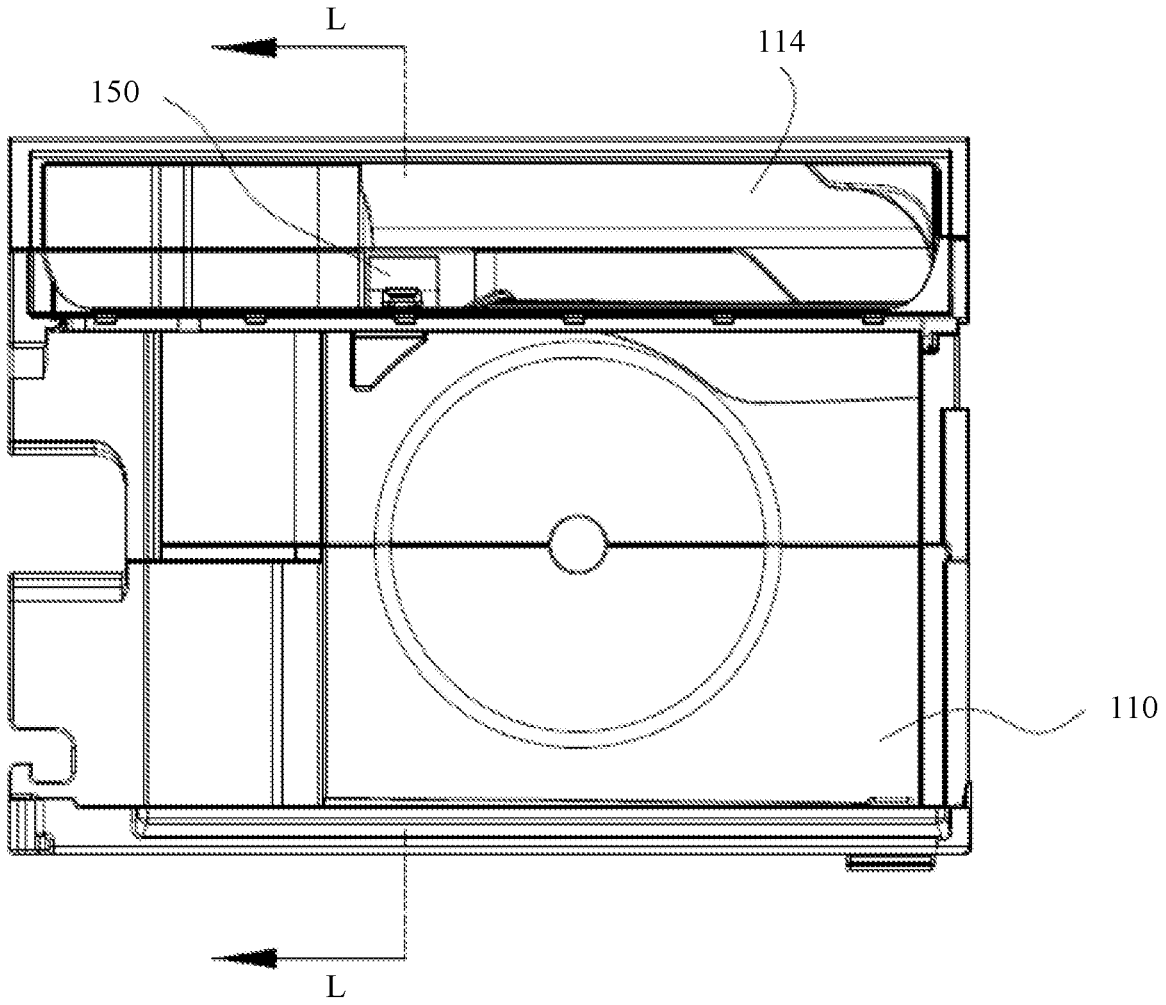
FIG. 20 is a front view of an indoor unit, in accordance with some embodiments.
Figure 22:
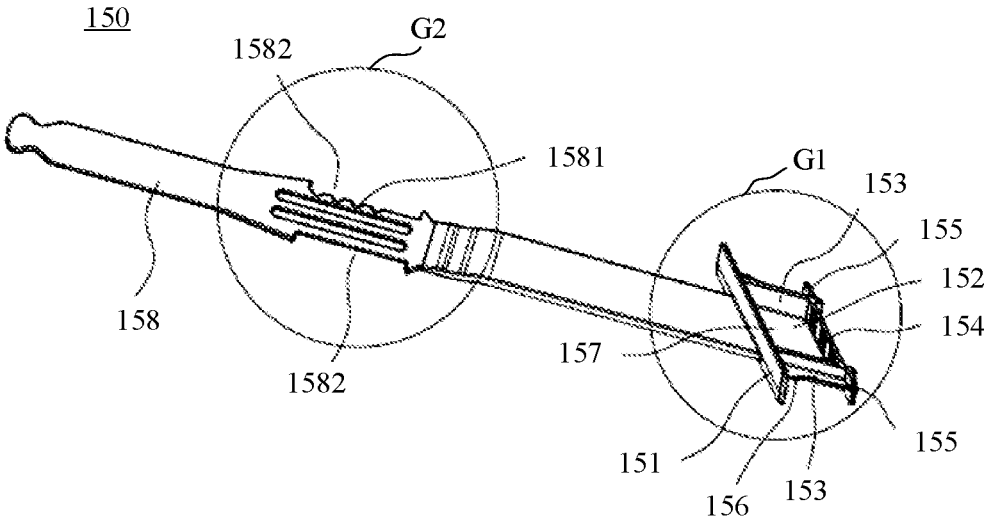
FIG. 22 is a structural diagram of a fresh air member, in accordance with some embodiments.
Figure 23:
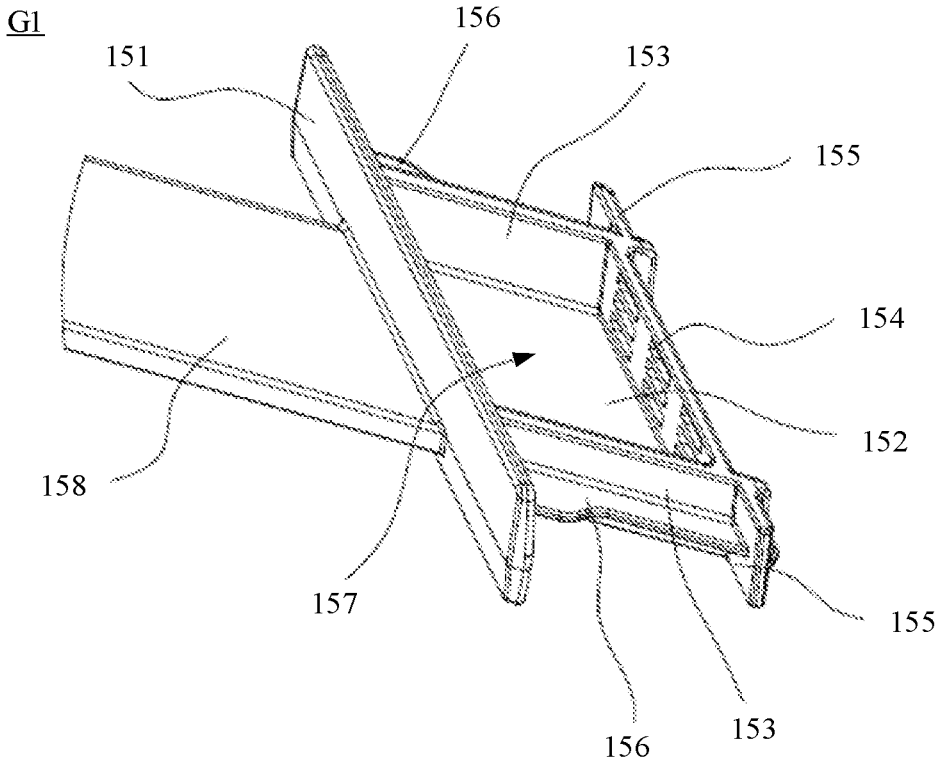
FIG. 23 is a partial enlarged view of the circle G1 in FIG. 22.

FIG. 20 is a front view of an indoor unit, in accordance with some embodiments. FIG. 21 is a cross-sectional view taken along the line L-L in FIG. 20. FIG. 22 is a structural diagram of a fresh air member, in accordance with some embodiments. FIG. 23 is a partial enlarged view of the circle G1 in FIG. 22.

In some embodiments, as shown in FIGS. 22 and 23, the fresh air member 150 includes a first baffle 151 and a bottom plate 152.

A size of the first baffle 151 is larger than that of the fresh air duct outlet 1133. That is, an orthogonal projection of the fresh air duct outlet 1133 on the first baffle 151 is located within the first baffle 151. Referring to FIGS. 17A and 20, in a case where the fresh air duct 113 is closed, the first baffle 151 closes the fresh air duct outlet 1133.

The bottom plate 152 is connected to a rear surface of the first baffle 151 (i.e., a surface of the first baffle 151 proximate to the fresh air duct outlet 1133), and extends rearward.

In some embodiments, the fresh air member 150 further includes two side plates 153. The two side plates 153 are respectively connected to left and right ends of the bottom plate 152, and are connected to the first baffle 151. Both side plates 153 extend rearward to a rear end of the bottom plate 152. In a case where the fresh air duct 113 is closed, the bottom plate 152 and the two side plates 153 are located in the fresh air duct 113. In a case where the fresh air duct 113 is opened, the bottom plate 152 and the two side plates 153 are located outside the fresh air duct 113.

In some embodiments, the fresh air member 150 further includes a filter mesh 154. The filter mesh 154 is connected to the rear end of the bottom plate 152 and the rear ends of the two side plates 153, and is located in the fresh air duct 113.

In some embodiments, the fresh air member 150 further includes two second baffles 155, and the two second baffles 155 are respectively connected to the two side plates 153 and extend in a direction away from the bottom plate 152. In the case where the fresh air duct 113 is closed, the two second baffles 155 are located in the fresh air duct 113. In the case where the fresh air duct 113 is opened, the two second baffles 155 are substantially coplanar with the fresh air duct outlet 1133.

It will be noted that, an orthogonal projection of the filter mesh 154 and the two second baffles 155 on the first baffle 151 is a first orthogonal projection, an orthogonal projection of the fresh air duct outlet 1133 on the first baffle 151 is a second orthogonal projection, and the first orthogonal projection substantially coincides with the second orthogonal projection.

In the case where the fresh air duct 113 is opened, the fresh air may enter the indoor through the filter mesh 154, while the insects and other impurities in the fresh air duct 113 may be blocked by the filter mesh 154 and the second baffles 155, so as to improve the experience of the user.

In some embodiments, as shown in FIGS. 22 and 23, the fresh air member 150 further includes two guide ribs 156. The two guide ribs 156 are respectively connected to the two side plates 153 and respectively extend away from the bottom plate 152 along surfaces of the two side plates 153 away from the bottom plate 152. A front end of each guide rib 156 is connected to the first baffle 151, and a rear end of each guide rib 156 is connected to the second baffle 155. The two guide ribs 156 abut against left and right plates of the fresh air duct 113 respectively.

It can be understood that, if the side plates 153 directly abut against the left and right plates of the fresh air duct 113, a large friction needs to be overcome, so as to make the fresh air member 150 slide. Therefore, the friction generated when the fresh air member 150 slides in the fresh air duct 113 may be reduced, and sliding smoothness of the fresh air member 150 may be improved by reserving a gap between the side plates 153 and the fresh air duct 113, and providing the guide ribs 156 on the side plates 153 to abut against the left and right plates of the fresh air duct 113. In addition, the guide ribs 156 may further serve as reinforcing ribs, so as to improve a structural strength of the fresh air member 150.

In some embodiments, as shown in FIG. 23, the fresh air member 150 further includes an air passing cavity 157. The first baffle 151, the bottom plate 152, the two side plates 153 and the filter mesh 154 jointly define the air passing cavity 157. In this way, in a case where the fresh air duct 113 is not fully opened, that is, in a case where the first baffle 151 does not abut against a periphery of the fresh air duct outlet 1133, and the second baffles 155 is located in the fresh air duct 113, the fresh air may enter the indoor through the air passing cavity 157 and the air outlet 114 after filtering by the filter mesh 154.

In some embodiments, as shown in FIGS. 19 and 22, the fresh air member 150 further includes a pulling rod 158. One end of the pulling rod 158 is connected to the first baffle 151, and another end of the pulling rod 158 extends forward from the front surface of the first baffle 151. The air outlet 114 may be opened or closed through pulling or pushing the pulling rod 158.

Figure 18A:
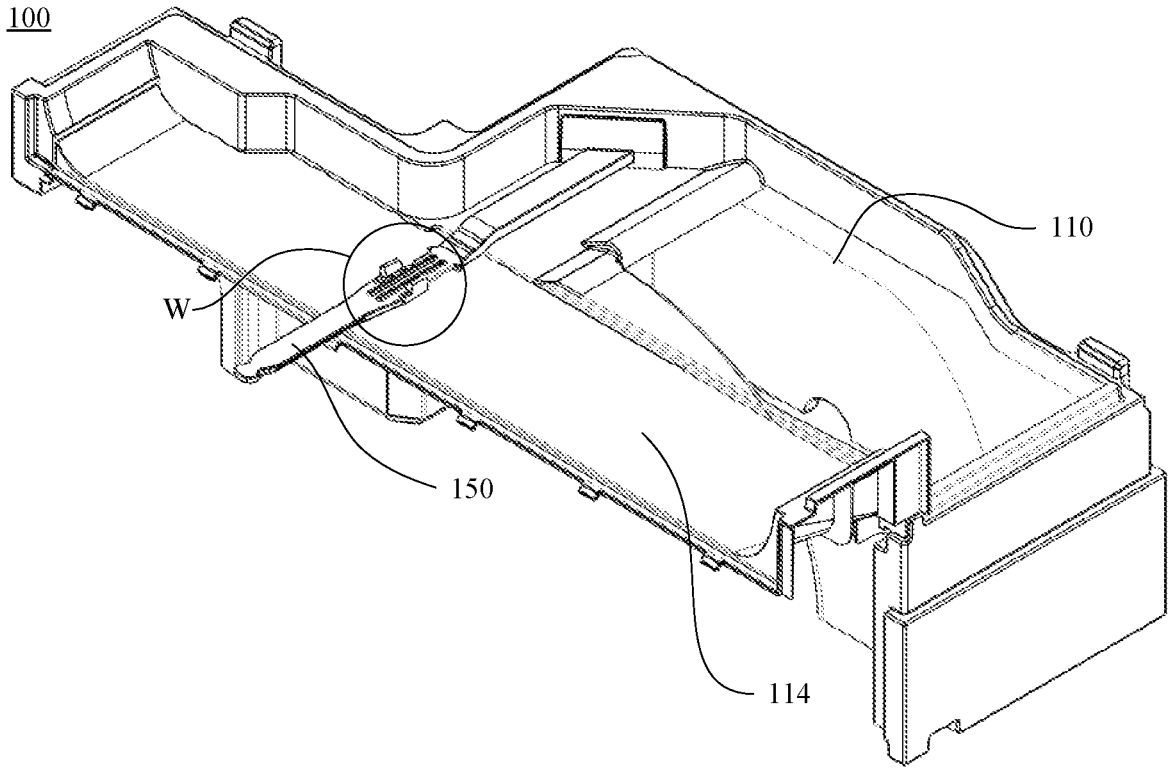
FIG. 18A is a perspective view of an indoor unit with a part of an indoor air duct component removed, in accordance with some embodiments.
Figure 18B:
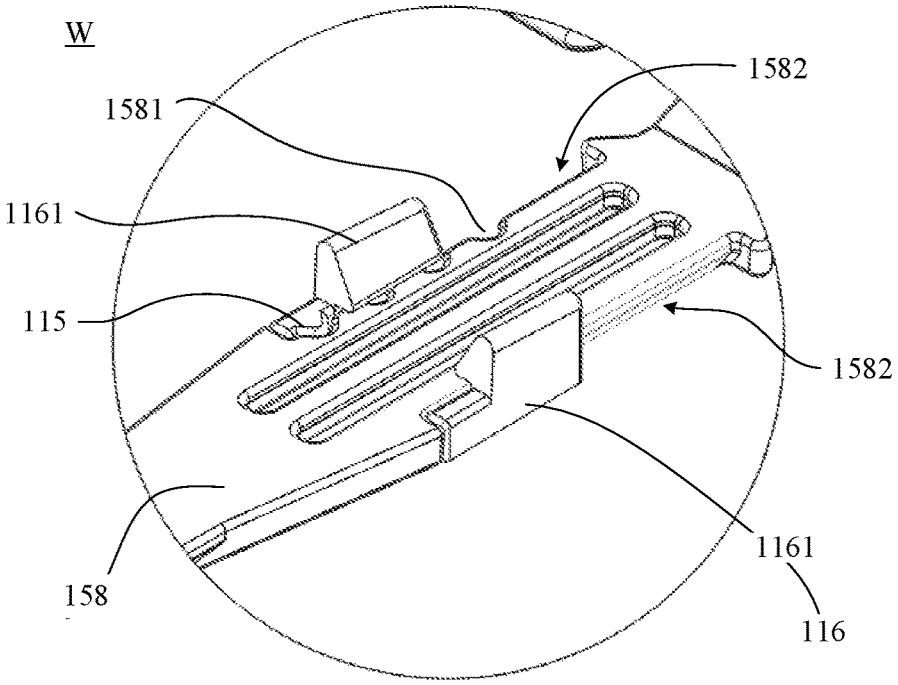
FIG. 18B is a partial enlarged view of the circle W in FIG. 18A.
Figure 24:
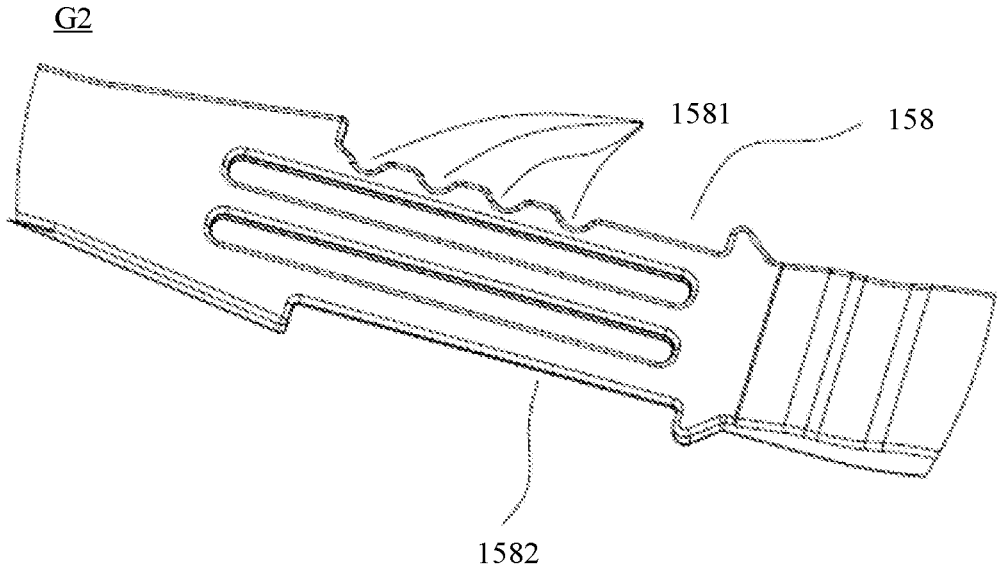
FIG. 24 is a partial enlarged view of the circle G2 in FIG. 22.

FIG. 18A is a perspective view of an indoor unit with a part of an indoor air duct component removed, in accordance with some embodiments. FIG. 18B is a partial enlarged view of the circle W in FIG. 18A. FIG. 24 is a partial enlarged view of the circle G2 in FIG. 22.

In some embodiments, as shown in FIGS. 18A, 18B, 22 and 24, the pulling rod 158 includes a blocking notch 1581. In a width direction (i.e., the left-right direction) of the pulling rod 158, a side of the pulling rod 158 is recessed inward, so as to form the blocking notch 1581. In some embodiments, the indoor air duct component 110 further includes a blocking portion 115. The blocking portion 115 is located on an inner side plate of the air outlet 114 and cooperates with the blocking notch 1581. In a case where the blocking portion 115 is engaged with the blocking notch 1581, the fresh air member 150 may be limited, so that the fresh air duct 113 is opened or closed.

For example, a position of the blocking portion 115 may be set such that in a case where the fresh air member 150 slides to a position that the blocking portion 115 is engaged with the blocking notch 1581, the fresh air duct 113 is closed or opened.

It will be noted that, the blocking notch 1581 is an arc-shaped notch, and the blocking portion 115 is a cylindrical structural member. Therefore, the blocking notch 1581 may be disengaged from the blocking portion 115 by applying a certain force to the pulling rod 158. That is, the fresh air member 150 is released in the front-rear direction.

In some embodiments, as shown in FIG. 24, the pulling rod 158 includes a plurality of blocking notches 1581. A plurality of blocking openings 1581 are arranged at intervals along a length direction of the pulling rod 158. In this way, the blocking portion 115 may be engaged with either of the plurality of blocking notches 1581, so that the fresh air duct 113 is opened to different degrees.

In some embodiments, as shown in FIGS. 18B and 22, the indoor air duct component 110 further includes a guide portion 116. The guide portion 116 is disposed in the air outlet 114 and a position of the guide portion 116 corresponds to a position of the pulling rod 158. The guide portion 116 is configured to guide and limit the pulling rod 158, so that the fresh air member 150 slides in the front-rear direction due to the guidance of the guide portion 116.

For example, referring to FIG. 18B, the guide portion 116 includes two guide buckles 1161 arranged opposite and spaced apart. The two guide buckles 1161 are respectively engaged with left and right sides of the pulling rod 158, so as to limit the pulling rod 158 in the left-right direction.

In some embodiments, as shown in FIGS. 17B, 18B and 22, the pulling rod 158 further includes two guide grooves 1582. The two guide grooves 1582 are respectively located on two sides of the pulling rod 158 and extend in a sliding direction of the pulling rod 158. Both of the two guide grooves 1582 penetrate through a rod body of the pulling rod 158 along a thickness direction thereof, and extend along a length direction of the pulling rod 158. In some embodiments, the two guide buckles 1161 are respectively engaged with groove bottoms of the two guide grooves 1582, so as to limit the pulling rod 158 in the left-right direction. The blocking notch 1581 may be disposed at a groove bottom of either of the two guide grooves 1582.

<Indoor Heat Exchanger>

In some embodiments, the indoor unit 100 further includes an indoor heat exchanger. The indoor heat exchanger is configured to make the indoor air exchange heat with the refrigerant conveyed in the indoor heat exchanger. For example, the indoor heat exchanger is used as an evaporator in a case where the air conditioner 1 is operating in a cooling mode, and in this case, the refrigerant is evaporated by absorbing heat in the indoor air through the indoor heat exchanger. The indoor heat exchanger is used as a condenser in a case where the air conditioner 1 is operating in a heating mode, and in this case, the refrigerant is condensed by dissipating heat into the indoor air through the indoor heat exchanger.

It can be understood that, in a case where the indoor heat exchanger is used as the evaporator, a temperature of the refrigerant in the indoor heat exchanger is low. Therefore, water vapor in the air is easily condensed on an outer surface of the indoor heat exchanger and forms droplets. The droplets fall downward due to gravity and collect as condensed water.

<Drainage Assembly>

Figure 25:
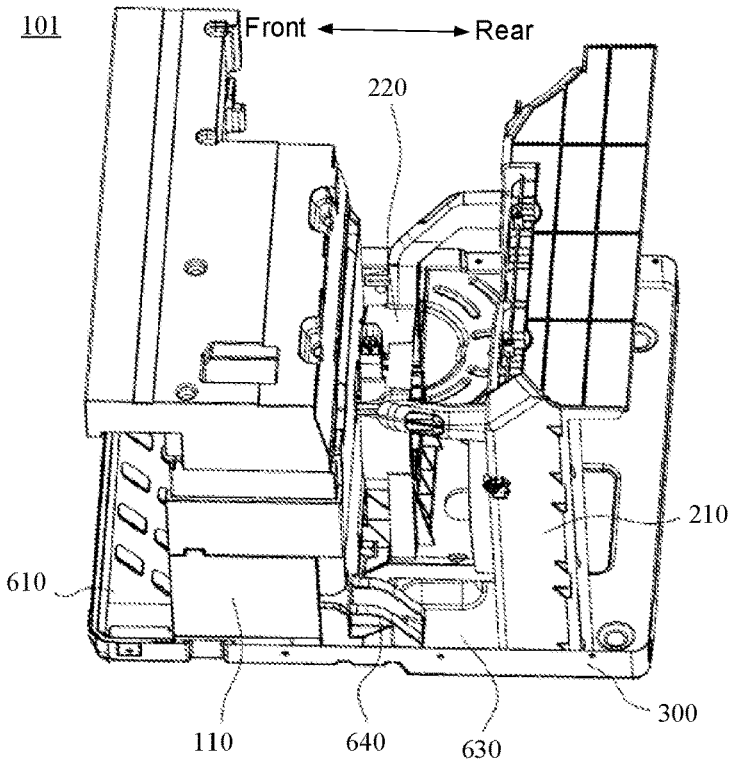
FIG. 25 is yet another perspective view of a main body, in accordance with some embodiments.
Figure 26:
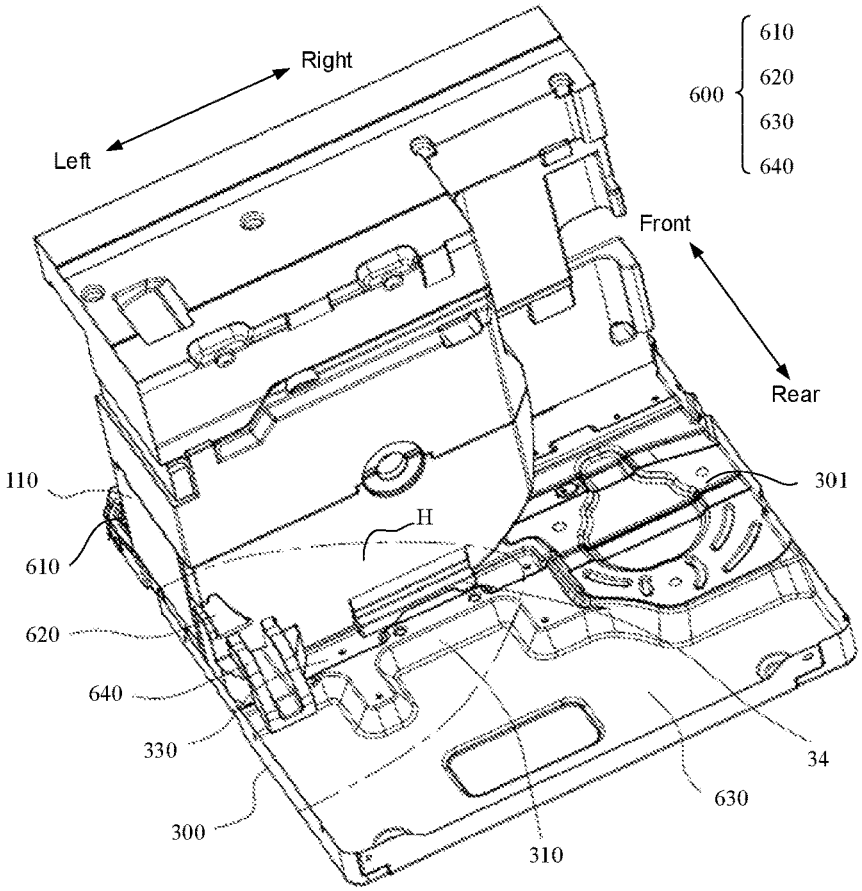
FIG. 26 is a perspective view of an air conditioner body with an outdoor unit removed, in accordance with some embodiments.
Figure 27:
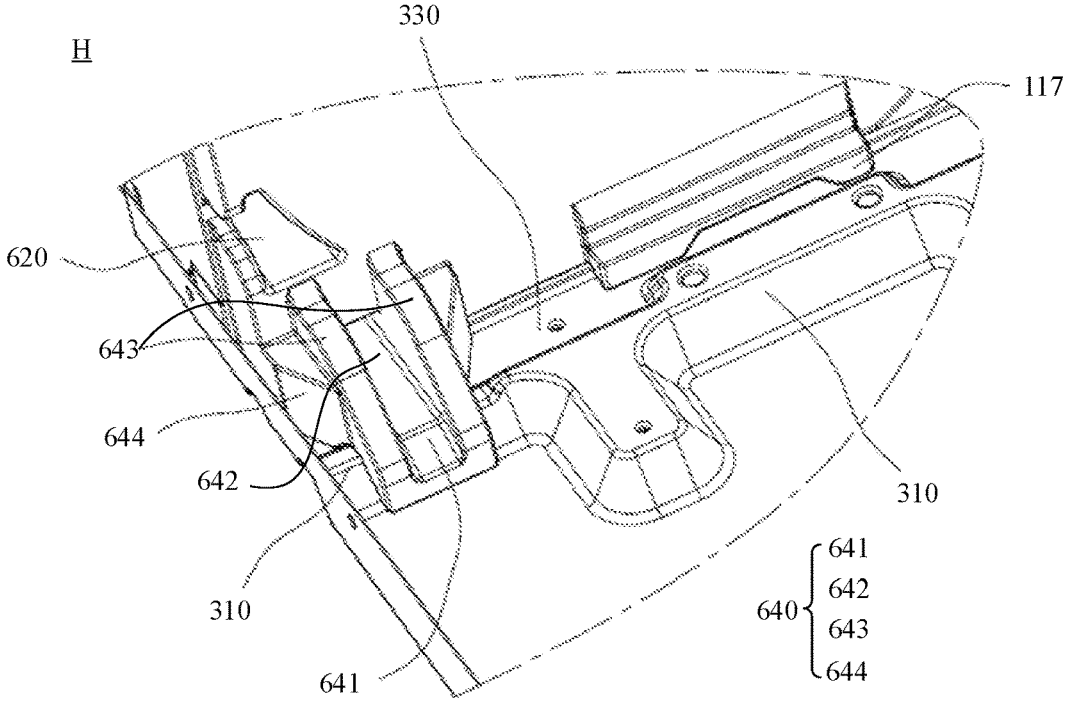
FIG. 27 is a partial enlarged view of the circle H in FIG. 26.

FIG. 25 is yet another perspective view of a main body, in accordance with some embodiments. FIG. 26 is a perspective view of an air conditioner body with an outdoor unit removed, in accordance with some embodiments. FIG. 27 is a partial enlarged view of the circle H in FIG. 26.

In some embodiments, as shown in FIGS. 25 and 26, the main body 101 further includes a drainage assembly 600. The drainage assembly 600 is configured to collect the condensed water generated by the indoor heat exchanger, and discharge the condensed water to the outdoor unit 200 due to gravity. In some embodiments, as shown in FIGS. 25 to 27, the drainage assembly 600 includes a drain pan 610, a drainage channel 620 and a water tank 630.

The drain pan 610 is disposed on the base 300 and is located on the front side of the indoor air duct component 110. The indoor heat exchanger is installed on the drain pan 610. A portion of a bottom plate of the base 300 extends downward, so as to form the water tank 630 that opens upward. The water tank 630 is located on the rear side of the indoor air duct component 110 and is located on the outdoor side of the air conditioner 1 (the outdoor side including the part of the air conditioner 1 located outdoors).

The drainage channel 620 is disposed in the indoor air duct component 110 and penetrates through the indoor air duct component 110 in an arrangement direction (i.e., the front-rear direction) of the indoor air duct component 110 and the outdoor air duct component 210. One end of the drainage channel 620 is connected to the drain pan 610, and another end of the drainage channel 620 is located at an upper portion of the water tank 630. In this way, the condensed water collected in the drain pan 610 may flow into the drainage channel 620 due to gravity. The condensed water in the drainage channel 620 may flow into the water tank 630 due to gravity.

It can be understood that, if the low-temperature condensed water directly collects on the base 300 and flows to the outdoor side through the drainage channel 620 on the base 300, a temperature of the base 300 decreases, and the water vapor in the indoor air is prone to condense on the outer surface of the base 300. Droplets condensed on the outer surface of the base 300 may drip into the housing 10, causing water to accumulate in the housing 10, and even causing a short circuit, which has a certain safety hazard. Therefore, by providing the drain assembly 600 in the main body 101, the condensed water generated by the indoor heat exchanger may be directly discharged to the water tank 630 located at the outdoor side, so that condensation on the outer surface of the base 300 may be avoided, which is conducive to improving the operation reliability of the air conditioner 1.

In some embodiments, as shown in FIGS. 26 and 27, the drainage assembly 600 further includes a water guiding member 640. One end of the water guiding member 640 corresponds to the another end of the drainage channel 620, and is connected to the rear side plate of the indoor air duct component 110. Another end of the water guiding member 640 extends downward and backward into the water tank 630. A water guiding channel 641 is defined in the water guiding member 640, one end of the water guiding channel 641 is communicated with the another end of the drainage channel 620, and another end of the water guiding channel 641 is communicated with the water tank 630.

During the operation of the air conditioner 1, the condensed water generated by the indoor heat exchanger may be collected into the water tank 630 located on the outdoor side through the drain pan 610, the drainage channel 620 and the water guiding channel 641 in sequence, so that condensation on the outer surface of the base 300 may be avoided, which is conducive to improving the operation reliability of the air conditioner 1.

In some embodiments, as shown in FIGS. 26 and 27, the water guiding member 640 includes a bottom plate 642 (which is called a water guiding member bottom plate 642) and two side plates 643 (which is called two water guiding member side plates 643) respectively disposed on both sides of the water guiding member bottom plate 642. The water guiding member bottom plate 642 and the two water guiding member side plates 643 jointly define the water guide channel 641. The two water guiding member side plates 643 extend upward from two sides of the water guiding member bottom plate 642 respectively, and are configured to block the condensed water, so that the condensed water flows into the water tank 630 through the water guiding channel 641.

Figure 28:
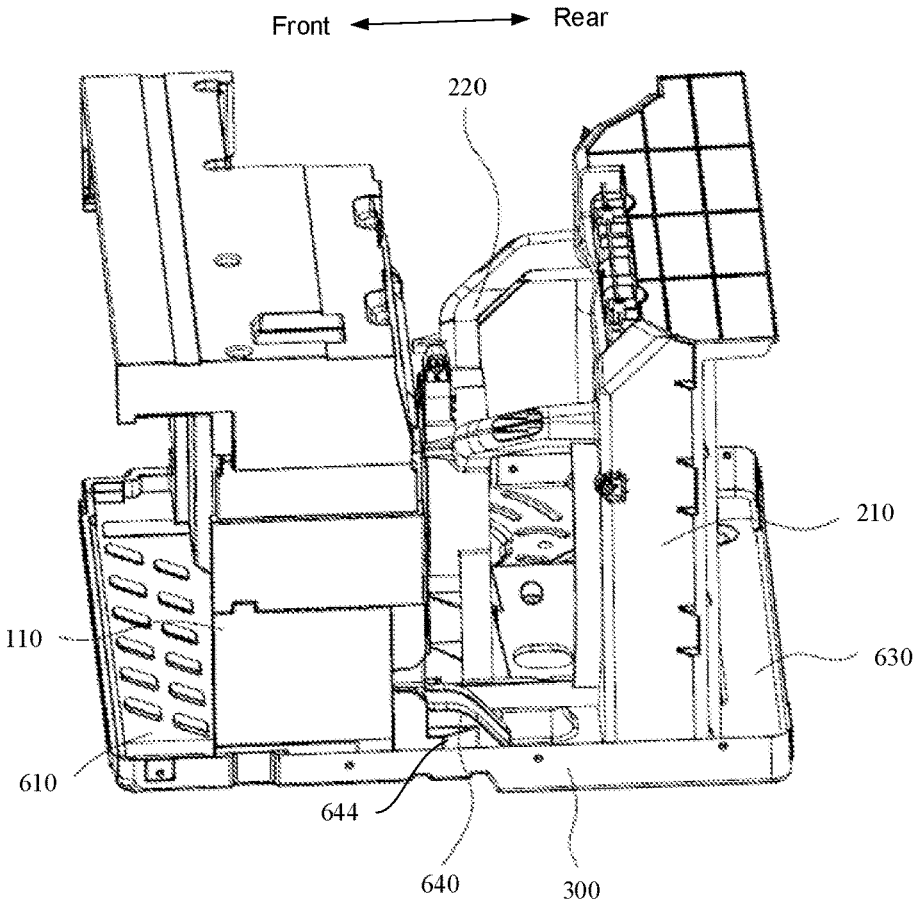
FIG. 28 is yet another perspective view of a main body, in accordance with some embodiments.

FIG. 28 is yet another perspective view of a main body, in accordance with some embodiments.

In some embodiments, as shown in FIGS. 27 and 28, the water guiding member 640 further includes two second reinforcing ribs 644. The two second reinforcing ribs 644 are respectively disposed on the two water guiding member side plates 643, and are connected to the indoor air duct component 110, so that the structural strength of the water guiding member 640 may be improved.

Figure 29:
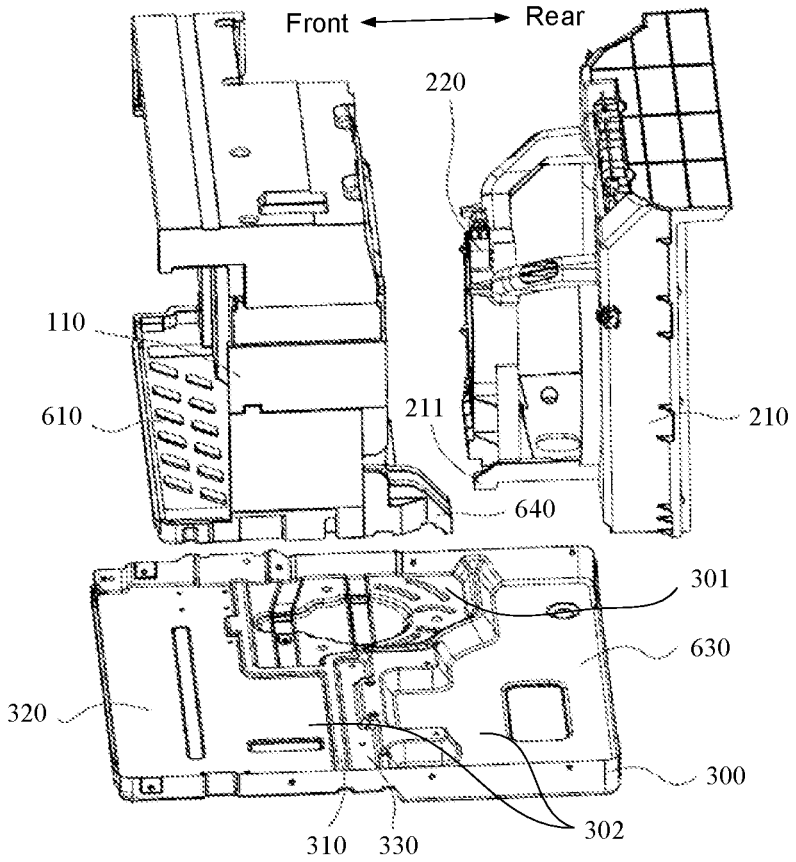
FIG. 29 is another exploded view of a main body, in accordance with some embodiments.
Figure 30:
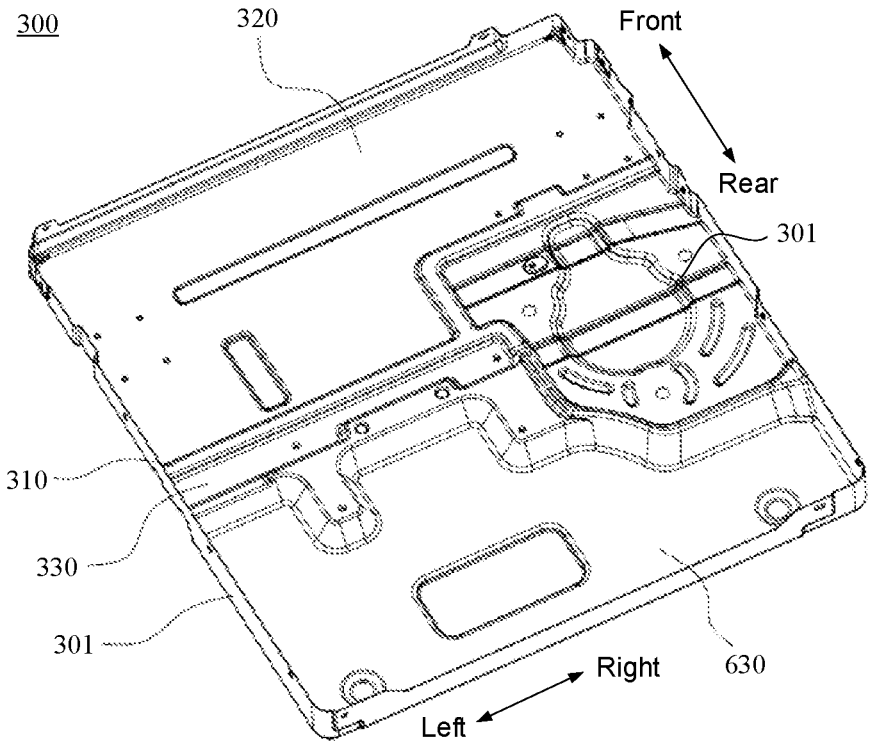
FIG. 30 is a structural diagram of a base, in accordance with some embodiments.

FIG. 29 is another exploded view of a main body, in accordance with some embodiments. FIG. 30 is a structural diagram of a base, in accordance with some embodiments.

In some embodiments, as shown in FIGS. 29 and 30, the base 300 includes a first groove 301 and a second groove 302. The first groove 301 is configured to install the compressor 1011, the inductor assembly 400 and other components. The second groove 302 is configured to install the indoor air duct component 110, the outdoor air duct component 210, the indoor heat exchanger, the drainage assembly 600 and other components.

In some embodiments, as shown in FIG. 30, the second groove 302 includes a barrier rib 310 and a second mounting groove 320. The barrier rib 310 is located in the middle of the second groove 302 along the front-rear direction, and extends from a left side plate of the second groove 302 to a right side plate of the second groove 302, so that the second groove 302 is divided into the second mounting groove 320 and the water tank 630.

The second mounting groove 320 is located on a front side of the barrier rib 310, and the water tank 630 is located on a rear side of the barrier rib 310. The drain pan 610 is disposed in the second mounting groove 320. The water guiding member 640 is disposed on the barrier rib 310, so that the water guiding member 640 is spaced apart from a groove bottom of the water tank 630 by a certain distance. In this way, rainwater or condensed water in the outdoor side may be prevented from flowing into the indoor side through the water guiding member 640.

In some embodiments, in the height direction of the air conditioner 1, a groove bottom of the second mounting groove 320 is higher than that of the water tank 630, so as to prevent rainwater or condensed water in the outdoor side from flowing into the indoor side (including the part of the air conditioner 1 located indoors).

In some embodiments, as shown in FIG. 30, the base 300 further includes a positioning groove 330. A part of an upper surface of the barrier rib 310 is recessed downward, so as to form the positioning groove 330. An extending direction of the positioning groove 330 is same as that of the barrier rib 310. In some embodiments, referring to FIGS. 27 and 29, the indoor air duct component 110 further includes a second positioning portion 117, and the outdoor air duct component 210 further includes a third positioning portion 211. The second positioning portion 117 is engaged with the positioning groove 330, so that the indoor air duct component 110 is positioned on the base 300. The third positioning portion 211 is engaged with the positioning groove 330 so that the outdoor air duct component 210 is positioned on the base 300. In this way, assembly efficiency of the air conditioner 1 may be improved.

In some embodiments, the drain pan 610, the water guiding member 640 and the indoor air duct component 110 are integrally formed, so that the assembly process may be simplified and the assembly efficiency of the air conditioner 1 may be improved.

A person skilled in the art will understand that, the scope of disclosure in the present disclosure is not limited to specific embodiments discussed above, and may modify and substitute some elements of the embodiments without departing from the spirits of this application. The scope of this application is limited by the appended claims.

What is claimed is:

1. An air conditioner, comprising:

an indoor unit including an indoor air duct component;

an outdoor unit including an outdoor air duct component;

the indoor air duct component and the outdoor air duct component being spaced apart; and an inductor assembly located between the indoor air duct component and the outdoor air duct component, and including:

an inductor box shell having an accommodating space and including:

a shell side plate;

a first heat dissipation opening penetrating through the shell side plate along a thickness direction of the shell side plate;

a first water blocking portion corresponding to the first heat dissipation opening, and extending from an upper edge of the first heat dissipation opening to an outer side of the inductor box shell and downward, so as to block the first heat dissipation opening;

a shell top plate disposed on top of the shell side plate; and a second heat dissipation opening penetrating through the shell top plate along a thickness direction thereof;

an inductor disposed in the accommodating space; and an inductor box cover disposed on top of the inductor box shell, and including:

a cover top plate;

a third heat dissipation opening disposed on the cover top plate and communicated with the second heat dissipation opening; and a second water blocking portion disposed at the third heat dissipation opening.

2. The air conditioner according to claim 1, wherein the inductor box shell includes a plurality of first heat dissipation openings; the plurality of first heat dissipation openings are arranged at intervals along a height direction of the air conditioner.

3. The air conditioner according to claim 1, wherein an opening direction of the third heat dissipation opening is substantially perpendicular to a height direction of the air conditioner;

the second water blocking portion includes a plurality of water blocking ribs, wherein the plurality of water blocking ribs are arranged at intervals along a length direction of the third heat dissipation opening; a part of an upper end of each water blocking rib is connected to an upper edge of the third heat dissipation opening, and a part of a lower end of each water blocking rib is connected to a lower edge of the third heat dissipation opening.

4. The air conditioner according to claim 1, wherein the inductor box cover further includes a third water blocking portion; the third water blocking portion is disposed on an inner surface of the cover top plate, and is located between the second heat dissipation opening and the third heat dissipation opening; a height of the third water blocking portion is greater than that of the second water blocking portion; in a horizontal plane where the second heat dissipation opening is located, the third water blocking portion is closer to the second heat dissipation opening than the second water blocking portion.

5. The air conditioner according to claim 4, wherein the third water blocking portion is of an annular structure;

an end of the third water blocking portion is connected to the cover top plate, and another end of the third water blocking portion extends toward the inductor box shell to exceed the horizontal plane where the second heat dissipation opening is located;

an orthogonal projection of the third water blocking portion on the horizontal plane where the second heat dissipation opening is located is an annular shape, and the second heat dissipation opening is located within the orthogonal projection.

6. The air conditioner according to claim 4, wherein the inductor box shell further includes a fourth water blocking portion; the fourth water blocking portion surrounds the second heat dissipation opening and extends toward the inductor box cover; with reference to the horizontal plane where the second heat dissipation opening is located, a distance between an end of the fourth water blocking portion close to the inductor box cover and the horizontal plane is greater than a distance between an end of the third water blocking portion close to the inductor box shell and the horizontal plane.

7. The air conditioner according to claim 1, wherein the inductor assembly further includes an inductor box base including:

a base body; the inductor being fixedly connected to the base body;

a first air inlet penetrating through the base body along a thickness direction of the base body;

a second air inlet disposed on a side plate of the base body and penetrating through the side plate along a thickness direction thereof; and an air inlet groove;

wherein, the base body is recessed to provide the air inlet groove; one end of the air inlet groove is communicated with an outer space of the inductor assembly, and another end of the air inlet groove is communicated with the first air inlet.

8. The air conditioner according to claim 1, further comprising a base; wherein, the indoor air duct component and the outdoor air duct component are disposed on the base, and the inductor assembly is located on a side of the indoor air duct component proximate to the outdoor air duct component;

the inductor assembly and the base are spaced apart by a preset distance.

9. The air conditioner according to claim 8, wherein the indoor unit further includes a mounting member;

the mounting member includes a first mounting plate; the first mounting plate is attached to a side plate of the indoor air duct component proximate to the outdoor air duct component, and an end of the first mounting plate is fixedly connected to the base;

the inductor assembly is fixedly connected to the first mounting plate.

10. The air conditioner according to claim 9, wherein the mounting member further includes a second mounting plate connected to the first mounting plate; the second mounting plate is substantially perpendicular to the first mounting plate and extends in a direction away from the outdoor air duct component; the second mounting plate is attached to a left side plate or a right side plate of the indoor air duct component.

11. The air conditioner according to claim 8, further comprising an electrical control assembly; wherein, the electrical control assembly is located at an upper portion of the indoor air duct component and the outdoor air duct component;

an end of the electrical control assembly proximate to the indoor air duct component is fixedly connected to a top plate of the indoor air duct component, and another end of the electrical control assembly proximate to the outdoor air duct component is fixedly connected to a top plate of the outdoor air duct component;

a distance between a lower surface of the electrical control assembly and the base is greater than a distance between an upper surface of the inductor assembly and the base.

12. The air conditioner according to claim 8, wherein the indoor unit further includes an indoor heat exchanger;

the air conditioner further comprises a drainage assembly configured to collect condensed water generated by the indoor heat exchanger and discharge the condensed water to the outdoor unit.

13. The air conditioner according to claim 12, wherein the drainage assembly includes:

a drain pan arranged on the base and located on a side of the indoor air duct component away from the outdoor air duct component; wherein, the indoor heat exchanger is installed on the drain pan;

a drainage channel disposed in the indoor air duct component, and penetrating through the indoor air duct component in an arrangement direction of the indoor air duct component and the outdoor air duct component; and a water tank located on the side of the indoor air duct component proximate to the outdoor air duct component;

wherein, an end of the drainage channel is connected to the drain pan, and another end of the drainage channel is located above the water tank.

14. The air conditioner according to claim 13, wherein the drainage assembly further includes a water guiding member; wherein, an end of the water guiding member corresponding to the another end of the drainage channel is connected to a side plate of the indoor air duct component proximate to the outdoor air duct component, and another end of the water guiding member extends into the water tank in a direction proximate to the outdoor air duct component;

the water guiding member includes a water guiding channel; an end of the water guiding channel is connected to the another end of the drainage channel, and another end of the water guiding channel is connected to the water tank.

15. The air conditioner according to claim 14, wherein the water guiding member further includes:

a water guiding member bottom plate being inclined downward in the arrangement direction of the indoor air duct component and the outdoor air duct component; and two water guiding member side plates respectively connected to both sides of the water guiding member bottom plate and extending upward;

wherein, the water guiding member bottom plate and the two water guiding member side plates jointly define the water guiding channel.

16. The air conditioner according to claim 1, wherein the indoor unit further includes a mounting groove; the mounting groove is disposed in the indoor air duct component, and is proximate to the outdoor air duct component; the mounting groove extends along a height direction of the air conditioner, and does not extend through a top portion of the indoor air duct component;

the inductor assembly is disposed in the mounting groove and is spaced apart from each groove wall of the mounting groove.

17. The air conditioner according to claim 1, wherein the indoor unit further includes a sound insulating member including:

a sound insulating plate disposed on a side plate of the indoor air duct component proximate to the outdoor air duct component; and a first fixing plate connected to a side of the sound insulating plate along a width direction of the air conditioner and extending in a direction away from the outdoor air duct component; the first fixing plate being fixedly connected to a side plate of the indoor air duct component along the width direction of the air conditioner.

18. The air conditioner according to claim 17, wherein the outdoor unit further includes a motor mounting frame; the motor mounting frame is located on a side of the outdoor air duct component proximate to the indoor air duct component, and is fixedly connected to the outdoor air duct component;

the sound insulating plate is fixedly connected to the motor mounting frame.

19. The air conditioner according to claim 1, wherein the indoor air duct component includes a fresh air duct;

the indoor unit further includes a fresh air member, and the fresh air member is slidably inserted in the fresh air duct, so as to open or close the fresh air duct; the fresh air member includes:

a first baffle;

a bottom plate; an end of the bottom plate being connected to a surface of the first baffle proximate to the fresh air duct, and extending in a same direction as the fresh air duct;

two side plates respectively connected to left and right sides of the bottom plate; an end of each of the two side plates being connected to the first baffle, and another end of each of the two side plates extending to another end of the bottom plate;

a filter mesh connected to the bottom plate and the another ends of the two side plates;

two second baffles respectively connected to the two side plates; both of the two second baffles extending in a direction away from the bottom plate, so as to abut an inner side plate of the fresh air duct.

20. The air conditioner according to claim 1, further comprising a base; wherein, the indoor air duct component and the outdoor air duct component are disposed on the base, and the inductor assembly is located on a side of the indoor air duct component proximate to the outdoor air duct component;

the inductor assembly is fixedly connected to the base.

* * * * *